US005823663A

United States Patent [19]

Bell et al.

[11] Patent Number: 5,823,663

[45] Date of Patent: Oct. 20, 1998

[54] FLUORESCENT TROFFER LIGHTING FIXTURE

[75] Inventors: L. Michael Bell, Jonesboro; Peter Michael Schmidt, Conyers, both of Ga.

[73] Assignee: National Service Industries, Inc., Atlanta, Ga.

[21] Appl. No.: 731,826

[22] Filed: Oct. 21, 1996

[51] Int. Cl.[6] ..... F21M 3/28

[52] U.S. Cl. ..... 362/362; 362/260

[58] Field of Search ..... 362/217, 260, 362/362

[56] References Cited

U.S. PATENT DOCUMENTS 4,814,954 3/1989 Spitz ..... 362/217
4,907,138 3/1990 Brueggemann et al. ..... 362/147
5,412,551 5/1995 Newell ..... 362/241

*Primary Examiner*—Stephen F. Husar
*Attorney, Agent, or Firm*—Kenneth E. Darnell

[57] ABSTRACT

An improved fluorescent troffer lighting fixture particularly intended for recessed mounting to a suspended ceiling grid, the fixture of the invention having a housing frame configured with spaced end plates which secure to a top plate and side flanges without the need for separate fasteners. The end plates, top plate and side flanges of the fixture housing snap-fit together through the use of cooperating fastening elements formed integrally with said end plates inter alia. The fixture housing mounts a louver and a channel with fastening structure integrally formed with the fixture housing, the channel mounting at least one fluorescent lamp and having reflective surfaces opposing said lamp for increasing efficiency of the fixture.

29 Claims, 19 Drawing Sheets

18
132
182
134
142
166
178
150
180
174
168
146
138
156
158
154
152
172
164
162
160
148
170
144
136
176
184

FLUORESCENT TROFFER LIGHTING FIXTURE

BACKGROUND OF THE INVENTION

1. Field of the Invention

The invention relates generally to fluorescent troffer lighting fixtures and particularly to a fixture housing formed of structural elements having integral fastening elements which allow rapid and efficient assembly of the fixture without the use of separate fasteners.

2. Description of the Prior Art

Fluorescent lighting has long been commonplace especially in commercial, institutional and industrial applications, the energy efficiency of fluorescent fixtures coupled with relatively low fixture cost causing fluorescent lighting to be the lighting of choice in most office situations as well as in task lighting applications inter alia. Parabolic-louvered troffers now set the standard in architectural lighting for most commercial and institutional applications. In such applications as in a commercial office building, literally thousands of fluorescent troffer lighting fixtures are mounted by suspended ceiling grid arrangements not only for lighting performance but also for pleasing appearance. Surface-mounted troffer fixtures also exist with similar performance features. The advent of the video display terminal and the particular lighting conditions required for use of such terminals has further led to improvements in parabolic troffer fixtures occasioned by the necessity to control reflected glare from overhead lighting. A particularly effective lighting system using parabolic-troffer fixtures for such an application is the Optimax Light Control System, a trademark of Lithonia Lighting, Inc. of Conyers, Georgia. In these differing applications, troffer fixtures have become essential components of the very architecture of commercial lighting systems. Within this context of differing lighting requirements, the need has increased in the industry to provide fixtures which can be manufactured at minimum cost yet exhibit exceptionally high performance. Further, these low-cost, high performance fixtures must be rapidly installable and must yield ever-increasing energy efficiencies while producing desired illuminance levels. Contemporary lighting systems and especially parabolic-troffer systems must therefore provide a marriage of aesthetics and performance at minimum manufacturing costs. Manufacturing costs can become a particular consideration in certain markets, those troffer fixtures requiring various combinations of hinging, latching and fastening through the use of separate fastening elements being more complex and thus more costly. Cost reductions become essential in the art and are often brought about through material choices for louver fabrication and thinner materials for louver and fixture body fabrication to name but a few. Additional economies are seen to be available from a design of fixture body assemblies to avoid the use of separate fastening elements in the manufacture of such assemblies. Forming structural portions of fixture body assemblies with integral fastening elements allows snap-fit assembly without the need for screws or the like which must be procured separately and separately brought to the assembly location. Fasteners such as screws are also difficult to work with in assembly situations due to their small size and the usual necessity for manual placement and manipulation of the fastener. In such situations, a tool is ordinarily required to secure the fastener to the structural elements of the fixture which must be joined together quickly and with precision.

An example of a fluorescent louvered lighting fixture is seen in U.S. Pat. No. 4,494,175 to Gawad et al. While Gawad et al intends the disclosure of a mounting arrangement for affixing a troffer to a fixture assembly, Gawad et al is considered pertinent as background to the present invention since this patent explicitly discloses the use of separate fasteners, particularly screws, to join together structural body elements of the disclosed fixture body assembly. The assembly practices described by Gawad et al are commonplace in the industry and represent the structure and methodology upon which the present invention intends improvement.

The invention thus provides a lighting fixture housing assembly and particularly a housing assembly for a parabolic troffer, the housing assembly being capable of snap-fit assembly of structural body elements without the need for separate fasteners. According to the invention, the structural body elements forming the housing assembly of the fixture are formed with fastening elements which are integral with the body elements, thereby avoiding the cost of separate fasteners and the difficulty of working with such fasteners. The invention in practice yields material cost savings as well as assembly cost savings while providing a fixture housing assembly having excellent mechanical performance and which contributes to overall fixture lighting performance. The advantages of the invention occur with the retention of traditional and necessary functions such as efficient louver mounting and the like.

SUMMARY OF THE INVENTION

The present invention provides a fluorescent troffer lighting fixture and particularly a fixture housing assembly which can be assembled from component parts amenable to automated fabrication. The housing assembly of the invention is characterized by simplicity and economy of construction while displaying unusually precise light control, the internal contours of the housing assembly acting to concentrate available light into those photometric zones most crucial to user comfort and efficiency. The rugged construction of the fixture housing assembly permits maintenance of desired body contours during handling and use after assembly, the ability of the present fixture housing assembly to assume and retain body contours including a continuation within the housing assembly of parabolic louver contours causing the fixture to exhibit excellent lighting performance. In essence, the internal contours of the housing assembly act to envelop the lamp or lamps mounted by the housing assembly in a fully reflective cavity, the strength of the housing assembly occasioned by the rugged yet precise configuration of said assembly causing the internal housing contours to remain in place relative to each other and thus to provide excellent lighting performance. The precise fitting of the component parts of the fixture housing assembly eliminates light leaks and minimizes shadows and bright spots.

The fixture housing assembly of the invention can be rapidly assembled from component parts capable of automated fabrication. These component parts include cooperating fastening elements formed integrally with the component parts, the integral fastening elements permitting inordinately rapid and ready assembly of the component parts to form the housing assembly. The integral fastening elements are configured to allow snap-fastening of the component parts together in a manner which assures a locking together of said component parts which is reliable and precise. The fixture housing assembly configured according to the invention is therefore capable of rapid and easy assembly without the use of separate fastening elements and which can be safely installed. The fixture housing assembly of the invention is incapable of accidental or inadvertent loss of structural integrity in an installation. Precise fixture configuration is assured according to the invention even though the component parts of the housing assembly are joined together rapidly in a mass assembly environment with snap-fitting fastening elements formed integrally with said component parts. Economies of fabrication and assembly are thereby realized without sacrifice of fixture performance.

Accordingly, it is an object of the invention to provide a louvered lighting fixture such as a fluorescent parabolic troffer fixture which is capable of superior mechanical and lighting efficiency even though the fixture is simply and ruggedly constructed and is capable of being rapidly assembled from component parts which can be fabricated using standard automated fabrication techniques.

It is another object of the invention to provide a lighting fixture and particularly a louvered lighting fixture such as a fluorescent parabolic troffer fixture which can be assembled through the expedient of fastening elements formed integrally with component parts of a fixture housing assembly, the housing assembly thus being capable of rapid and economical assembly from component parts which can be fabricated using standard automated fabrication techniques.

It is yet another object of the invention to provide a lighting fixture and particularly a louvered lighting fixture such as a fluorescent parabolic troffer fixture having a fixture housing assembly which can be rapidly and efficiently assembled without the need for separate fasteners.

Further objects and advantages of the invention will become more readily apparent in light of the following detailed description of the preferred embodiments.

DESCRIPTION OF THE PREFERRED EMBODIMENTS

Reference is made to co-pending United States patent application Ser. No. 08/_____entitled "Light Trap and Louver Mounting to Fluorescent Troffer Lighting Fixture", assigned to the present assignee, and filed of even date, the disclosure of said patent application being incorporated hereinto by reference.

Figure 1:
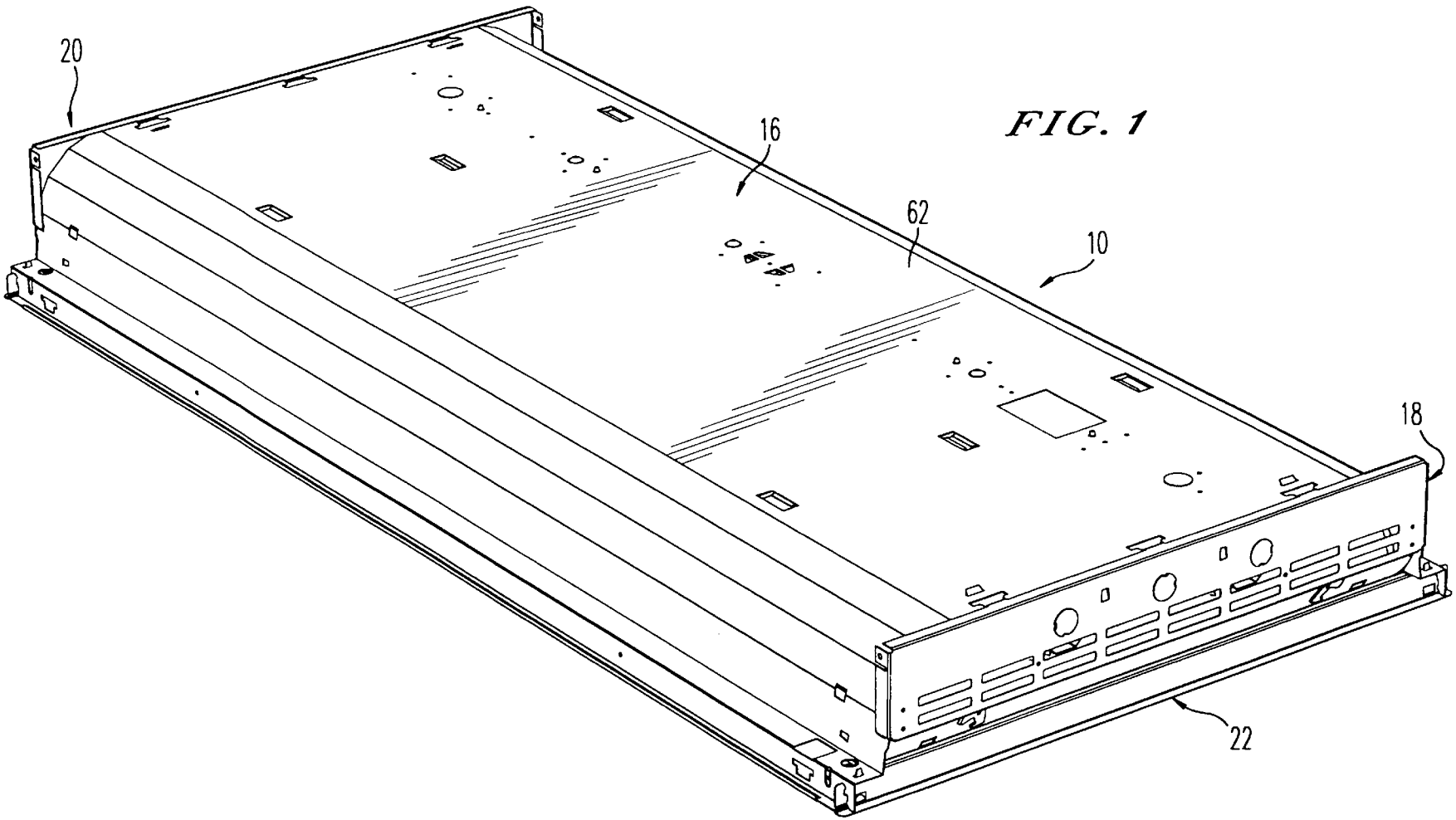
FIG. 1 is a perspective view of the lighting fixture of the invention taken from a location above and toward one end thereof.
Figure 2:
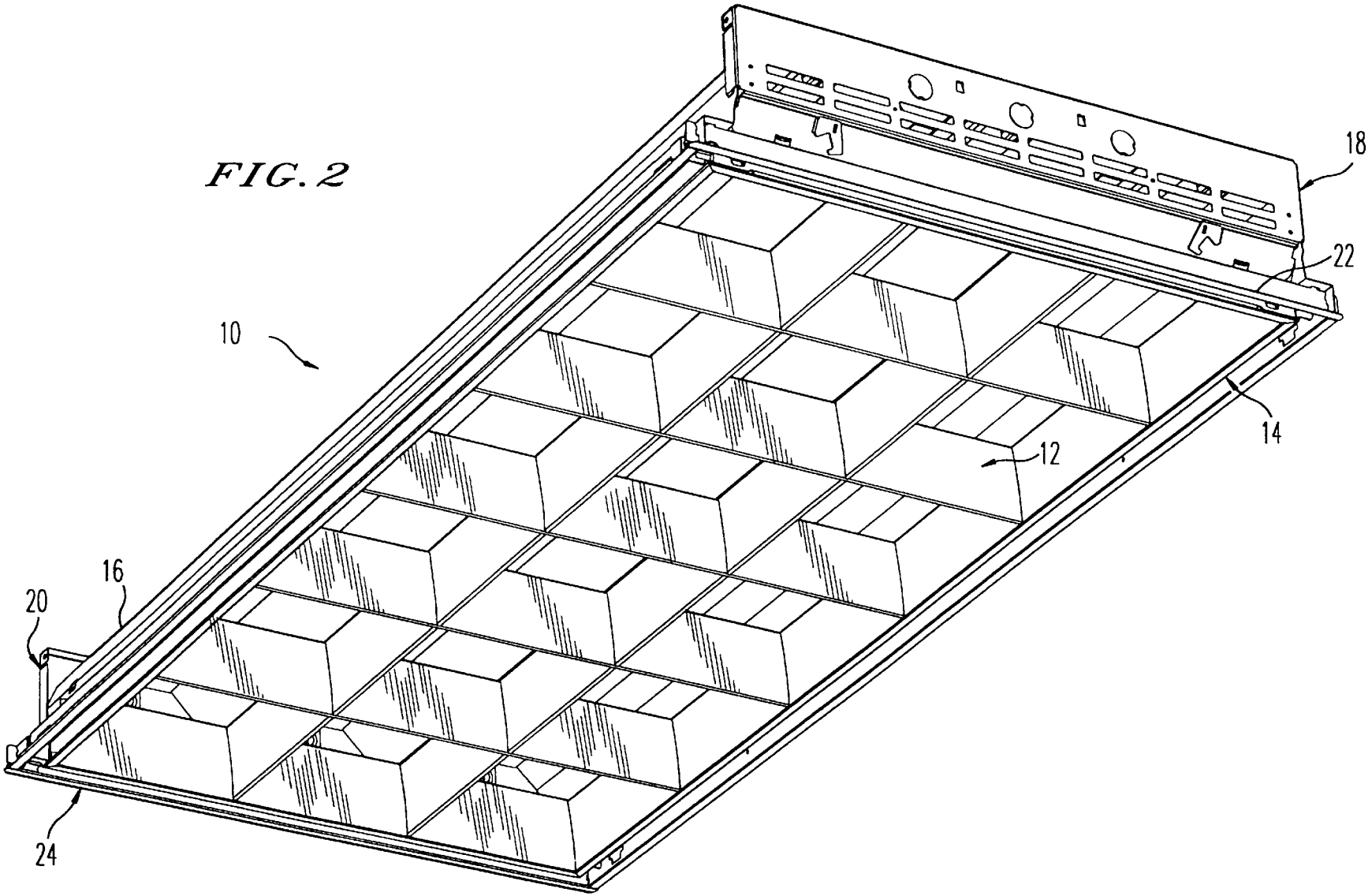
FIG. 2 is a perspective view of the lighting fixture of the invention taken from below and toward one end of the fixture.
Figure 3:
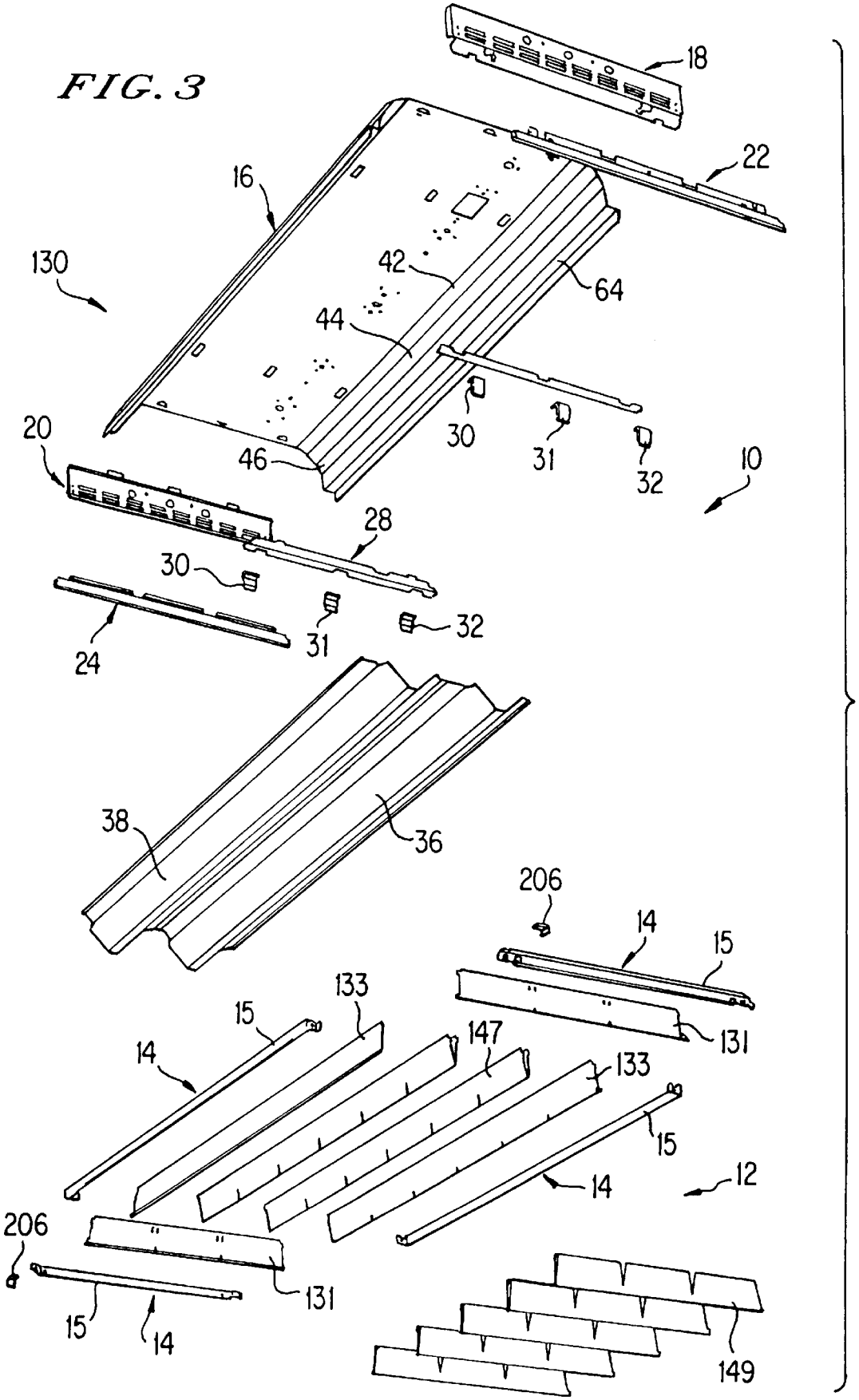
FIG. 3 is an exploded assembly view of the lighting fixture of FIGS. 1 and 2.

Referring now to the drawings and particularly to FIGS. 1 through 3, a lighting fixture configured according to the invention is seen generally at 10, the fixture 10 as shown being a troffer fixture intended to mount elongated fluorescent lamps as will be described hereinafter. The fixture 10 is provided with a louver 12 on the "underside" of the fixture 10, the louver 12 being positively mounted to housing 16 of the fixture 10 by means of a combined light trap and louver mounting assembly 14 which is disclosed in detail in the aforesaid co-pending United States patent application which is incorporated hereinto by reference. The housing 16 has respective end plates 18 and 20 connected respectively to open ends of the housing 16. Immediately below the end plate 18 is a side bar 22 which joins directly to the housing 16 at the end thereof and also to portions of the end plate 18. Similarly, a side bar 24 is located immediately below the end plate 20 and connects to the housing 16 and to the end plate 20. A socket strip 26 is located at that end of the housing 16 to which the end plate 18 is attached, a virtually identical socket strip 28 being similarly disposed at the opposite end of the housing 16. The socket strips 26 and 28 respectively mount lamp sockets 30, 31 and 32, the sockets 30, 31 and 32 receiving elongated fluorescent lamps (not shown) in a known manner. Although not shown, the socket strip 26 may differ from the socket strip 28 by the provision of two semi-circular cut-outs (not shown) whereas the socket strip 28 has only one cut-out 35, the cut-outs functioning as access openings for wiring (not shown). Lamp channels 36 and 38 mount within the interior of the housing 16, the channels 36 and 38 being shaped to continue the parabolic shape of the louver 12 thereby to respectively envelop each of the fluorescent lamps (not shown) in a substantially fully reflective cavity which is also partially formed by surfaces of the housing 16 adjacent to the lamp channels 36, 38 as will be described in more detail hereinafter.

While the lighting fixture 10 is shown as comprising a recessed fixture which can be conveniently and conventionally mounted to suspended ceilings (not shown) such as are formed of spaced grid elements (not shown), it is to be understood that at least certain features of the fixture 10 can be employed in the construction of a surface-mounted lighting fixture of the parabolic troffer type. Still further, while the lighting fixture 10 mounts three of the elongated fluorescent lamps (not shown), it is to be understood that lighting fixtures configured according to the invention can be formed to have more or less than the three lamps described herein. Of substantial importance in a consideration of the structure of the lighting fixture 10 is the fact that the fixture 10 as configured provides no visible change in shape or appearance to a user either configured as a recessed fixture as is shown in the drawings or as a surface-mount fixture. It is also to be understood that the lighting fixture 10 of the invention as described herein can be economically produced at a cost which is relatively low when compared to presently available lighting fixtures of similar type and performance. As indicated hereinabove, the lighting fixture 10 can be rapidly assembled from component parts produced by automated fabrication techniques, assembly being possible without the use of additional hardware including fasteners and the like which are separate elements normally requiring the use of tools and requiring manual manipulation in an assembly situation. While the lighting fixture 10 of the invention can be assembled by means of fastening elements integrally formed with component parts of said fixture 10, the structure of the fixture 10 exhibits unexpected rigidity due to the fact that the component parts of the fixture 10 are positively secured together by means of the several integral fastening elements formed on component parts of said fixture. All mechanical structure forming the lighting fixture 10 are snap-fit together and held by the integral fastening elements formed with the several component parts of said fixture 10 with the exception of ballast structure which is to be described briefly hereinafter and which must be mounted to a lighting fixture such as the fixture 10 by means of screws (not shown) according to code requirements.

Figure 4A:
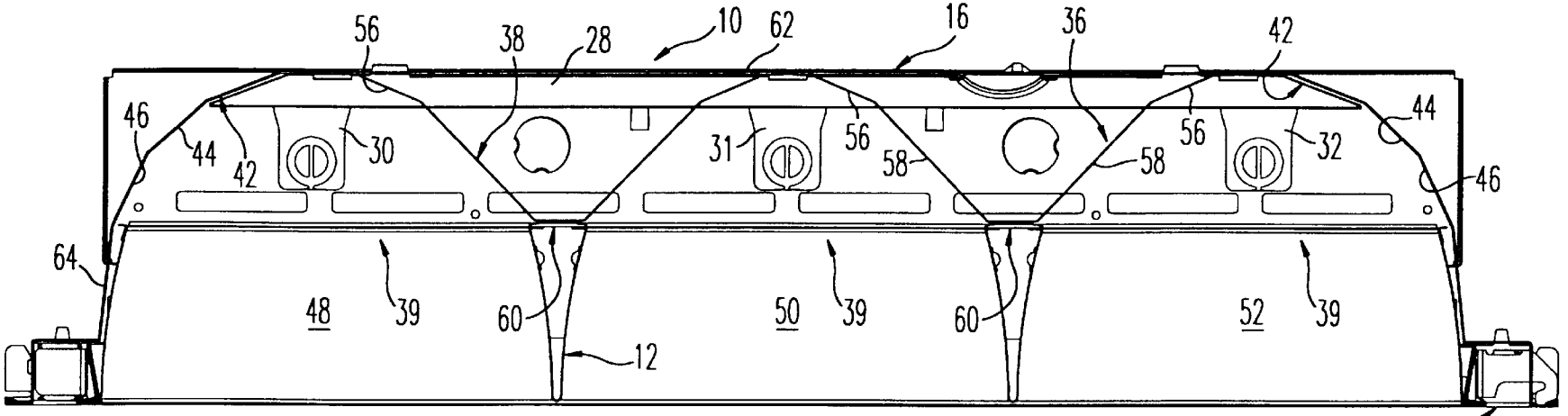
FIGS. 4A and 4B are end elevational views in section illustrating in FIG. 4A the cooperation of a louver, lamp channels and housing contours to maintain a generally parabolic configuration, FIG. 4B illustrating the structure absent the louver.

Referring again to the drawings and particularly to FIGS. 4A, the housing 16 is shown to have the louver 12 and the light trap and louver mounting assembly 14 mounted thereto, the lamp channels 36 and 38 further being attached to interior upper surfaces of the housing 16 as will be described hereinafter. Fluorescent lamps are not shown for ease of illustration. Top wall 62 of the housing 16 comprises a planar body element with interior reflective elongated planar surfaces 42, 44 and 46 respectively being formed in interior surfaces of the housing 16 between said top wall 62 and each of the side walls 64. Each of the reflective elongated planar surfaces 42, 44 and 46 essentially take the form of rectangles having lengths which are substantially greater than the widths of said surfaces 42, 44 and 46. The surfaces 42, 44 and 46 essentially form portions of reflective cavities 39 on each side of the housing 16 in concert with respective outer and medial reflective planar surfaces 56, 58 formed on interior walls of the lamp channels 36 and 38. Fluorescent lamps (not shown) are mounted within said reflective cavities 39 so defined with said lamps being disposed respectively above rows of cells 48, 50 and 52 of the louver 12. Each of the lamp channels 36, 38 effectively terminate centrally in a flat apexal planar surface 60, each of the surfaces 60 being disposed respectively between the rows of the cells 48, 50 and 52. As is thus seen in FIG. 4A, certain interior surface wall portions of the housing 16, that is, the reflective elongated planar surfaces 42, 44 and 46 on each side of said housing 16 act to continue the parabolic shape of the cells 48 and 52 respectively of the louver 12. Further, the contours of the lamp channels 36, 38, that is, the reflective planar surfaces 56, 58 on either side of each of the lamp channels 36, 38 function to continue the parabolic shape of at least portions of the cells 48, 50 and 52. Interior surfaces of the lamp channels 36, 38 and particularly the surfaces 56, 58 as well as interior surfaces of the housing 16, particularly the reflective planar surfaces 42, 44 and 46 can be coated with a paint or other coating having high light reflectivity in order to increase the lighting efficiency of the fixture 10. The contours of the lamp channels 36, 38 and the contours of the surfaces of the housing 16 which have been described immediately above are seen to be maintained in place by the rigidity of the lighting fixture 10 with the component parts of the fixture 10 being positively secured together by means of snap-fitting fastening structure as will be described hereinafter. It is important to the most efficient functioning of the lighting fixture 10 to have these cooperating reflective surfaces, that is, the several surfaces 42, 44 and 46, as well as the surfaces 56, 58, held in place through a positive securement of the component parts of said fixture 10. Further, it is important that the louver 12 be positively secured in place and rigidly held to the lighting fixture 10 so that the necessary characteristics of a louvered parabolic troffer are created and maintained.

Figure 4B:
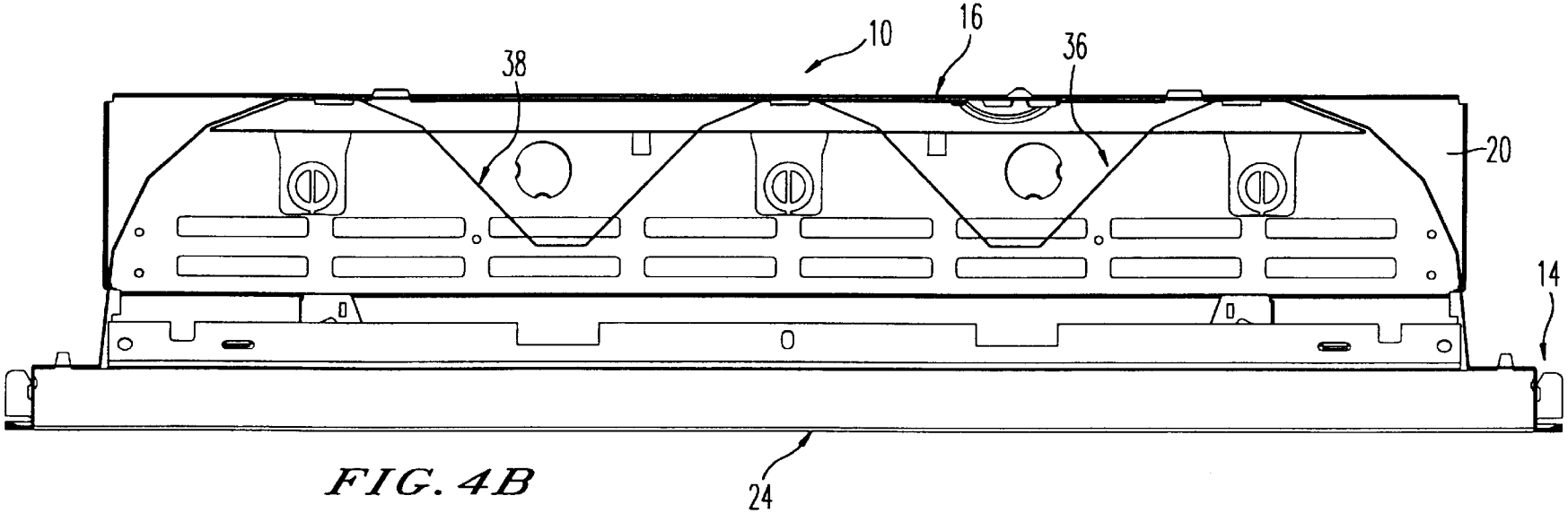

FIG. 4B illustrates the structure of FIG. 4A without the louver 12 in order to show the relationship of the end plate 20 and the side bar 24 with the geometry of the lamp channels 36, 38 and the various reflective surfaces of the channels 36, 38 which cooperate with the reflective surfaces 42, 44 and 46 of the housing 16 as described herein.

Referring now once again to the drawings and particularly to FIGS. 5 and 10A through D inter alia, details of the housing 16 can be further appreciated. The housing 16 can be formed from a single sheet of material, typically steel, to comprise the top wall 62 and the side walls 64 which effectively form a U-shaped structural element. Each lengthwise edge 66 and 68 is integrally formed with an L-shaped channel 70, the channels 70 being essentially identical for ease of fabrication and assembly. The L-shaped channel 70 extends substantially along the full lengths of the edges 66 and 68, the channels 70 being each formed of a horizontal flange 72 and a vertical flange 74. Each of the vertical flanges 74 bend laterally outwardly to form an edge flange 76 which preferably terminates in an edge portion 77 which recurves by 180° to form a stiffened outer edge. Since the L-shaped channels 70 are identical, a description of one will suffice for a description of both. At each end of each one of the L-shaped channels 70, a joinery cutout 78 is formed as by a punching process. The cutout 78 is at least partially formed of two rectangular apertures 80 and 82 laterally offset from each other and joined along a portion of imaginary edges thereof. The edge flange 76 terminates essentially along the imaginary line extending downwardly from between the apertures 80 and 82. End 79 of the vertical flange 74 outwardly of the cutout 78 terminates slightly above an imaginary extension of the top surface of the edge flange 76 and does not recurve to form a flange on remaining portions of the vertical flange 74. A substantially V-shaped entry aperture 84 extends toward and communicates with the aperture 80 to further form the cutout 78. The aperture 84 is defined inwardly at 81 by the discontinuation of that portion of the vertical flange 74 having the edge flange 76 extending therealong. The outward portion of the aperture 84 is defined by a slanted edge 86 which terminates in a vertical edge 88 undercut by shoulder 90. The joinery cutouts 78 receive in a snap-fitting manner respective integral fastening elements formed on each end of each one of the side bars 22, 24 as will be described in detail hereinafter. A rectangular aperture 92 is formed in the horizontal flange 72 of each of the channels 70 near each end thereof, the apertures 92 being essentially aligned with the respective cutouts 78, the two ends of each of the L-shaped channels 70 being essentially identical as aforesaid. Although not shown in the drawings, a plurality of elongated air passage slots can be formed inwardly of the ends of the horizontal flanges 72 and essentially along the lengths thereof to provide a path for air to pass vertically at the sides of the fixture 10 when mounted to a suspended ceiling grid (not shown) or the like.

Immediately inwardly of the cutout 78, a vertical slot 96 is formed which extends through rounded edge 98 between the flanges 72 and 74, the slot 96 having a minor portion extending into the horizontal flange 72. The slots 96 facilitate mounting of the light trap and louver mounting assembly 14 to the housing assembly 130 as is described in co-pending patent application Ser. No. 08/_____ filed of even date and incorporated hereinto by reference, the patent application being assigned to the present assignee. Inner surfaces of each of the L-shaped channels 70 as well as a downward face of the edge flange 76 can be painted black in order to match the desired color of the side bars 22 and 24 as well as the color of the light trap and louver mounting assembly 14. Inner walls of the side walls 64 adjacent the horizontal flanges 72 can also be painted black to impart an appearance to the fixture 10 which is essentially identical to other lighting fixtures of similar type which are presently available. Other features of the fixture 10 also impart to the lighting fixture 10 an appearance essentially identical to other lighting fixtures of similar type, the lighting fixture 10 therefore being interchangeable with such presently available lighting fixtures in either a retrofit situation or in an originally equipped arrangement.

Near the ends of the L-shaped channels 70, the side walls 64 of the housing 16 respectively enlarge at 100 to define the full length of the housing 16. Immediately inwardly of each enlargement is formed a rectangular aperture 102, a total of four of the apertures 102 being formed in the housing 16 with one each of the apertures 102 being located at each corner of the housing 16 at the respective ends of the side walls 64. The rectangular apertures 102 function in a manner which will be described in detail hereinafter.

Referring again to FIG. 5, ballasts 106 and 108 are shown in phantom to be mounted to the underside of the top wall 62 of the housing 16 through the expedient of punched-out tabs 110 which engage edges (not shown) of the ballasts 106, 108, the opposite ends of the ballasts 106, 108 being mounted to inner surface portions of the top wall 62 by means of screws (not shown) which are received within apertures 112 in a conventional manner. Accordingly, only two screws are necessary to maintain the ballasts 106, 108 in place and to conform to code requirements relative to the mounting of ballasts in a fixture such as the lighting fixture 10. Wiring (not shown), including a ground wire attached to the housing 16 by means of a screw (not shown) received in aperture 114, extends between the ballasts 106, 108 and the sockets 30, 31 and 32, in order to provide power to fluorescent lamps (not shown). The operation of the electronic and electrical portions of the fixture 10 are conventional and need not be described in detail herein. The management of the wiring at the socket strips 26, 28 will be described in some detail hereinafter. The ballasts 106, 108 and the wiring (not shown) are disposed within a chamber defined by the lamp channel 36. It is to be understood that the lamp channel 38 could provide this housing function. Since the ballasts 106, 108 and the wiring (not shown) are covered by the lamp channel 36, these electronic and electrical portions of the fixture 10 do not interfere with a desired reflection of light internally of the fixture 10.

Figure 5:
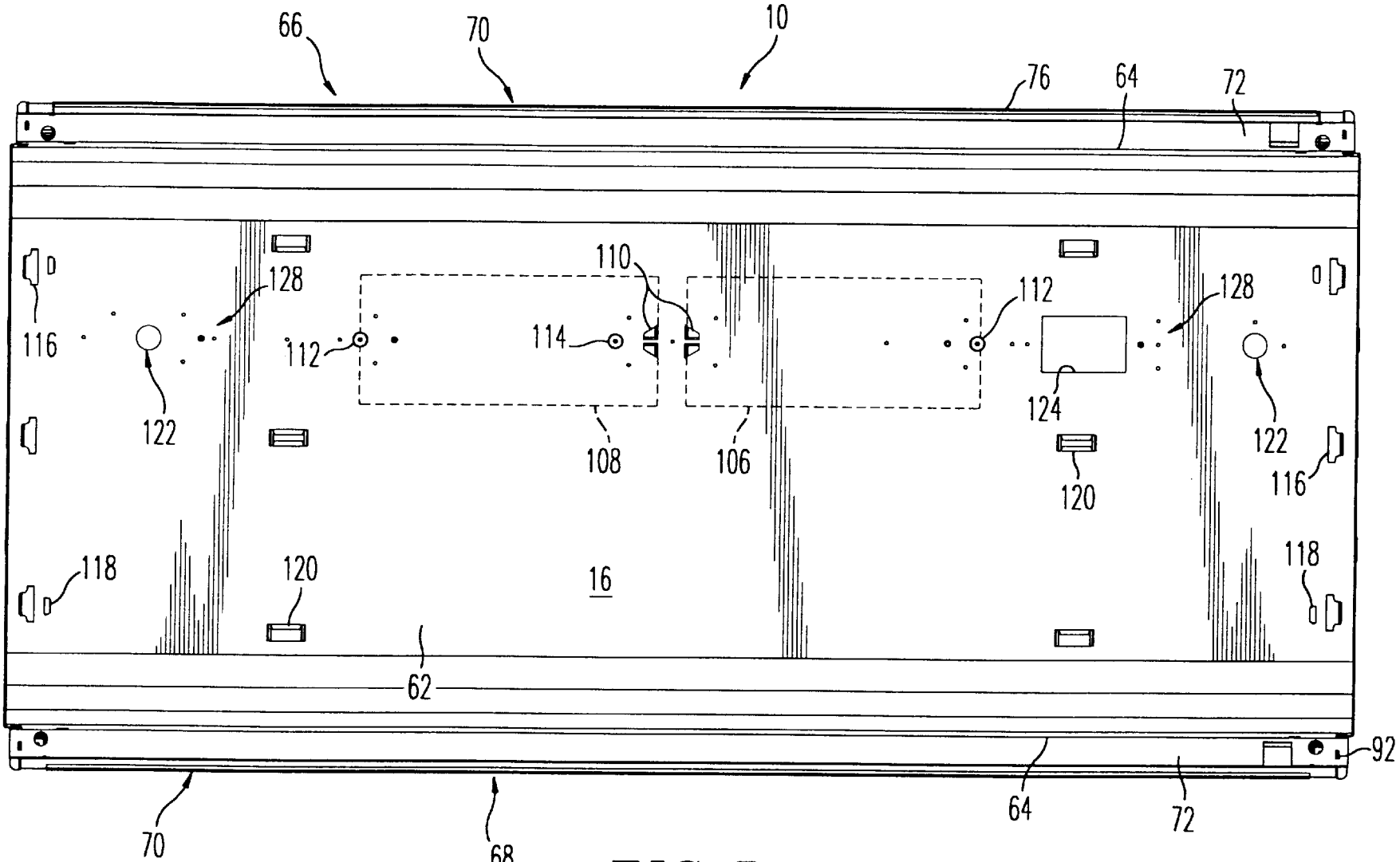
FIG. 5 is a plan view of a housing of the lighting fixture.
Figures 6A, 6B, 6C:
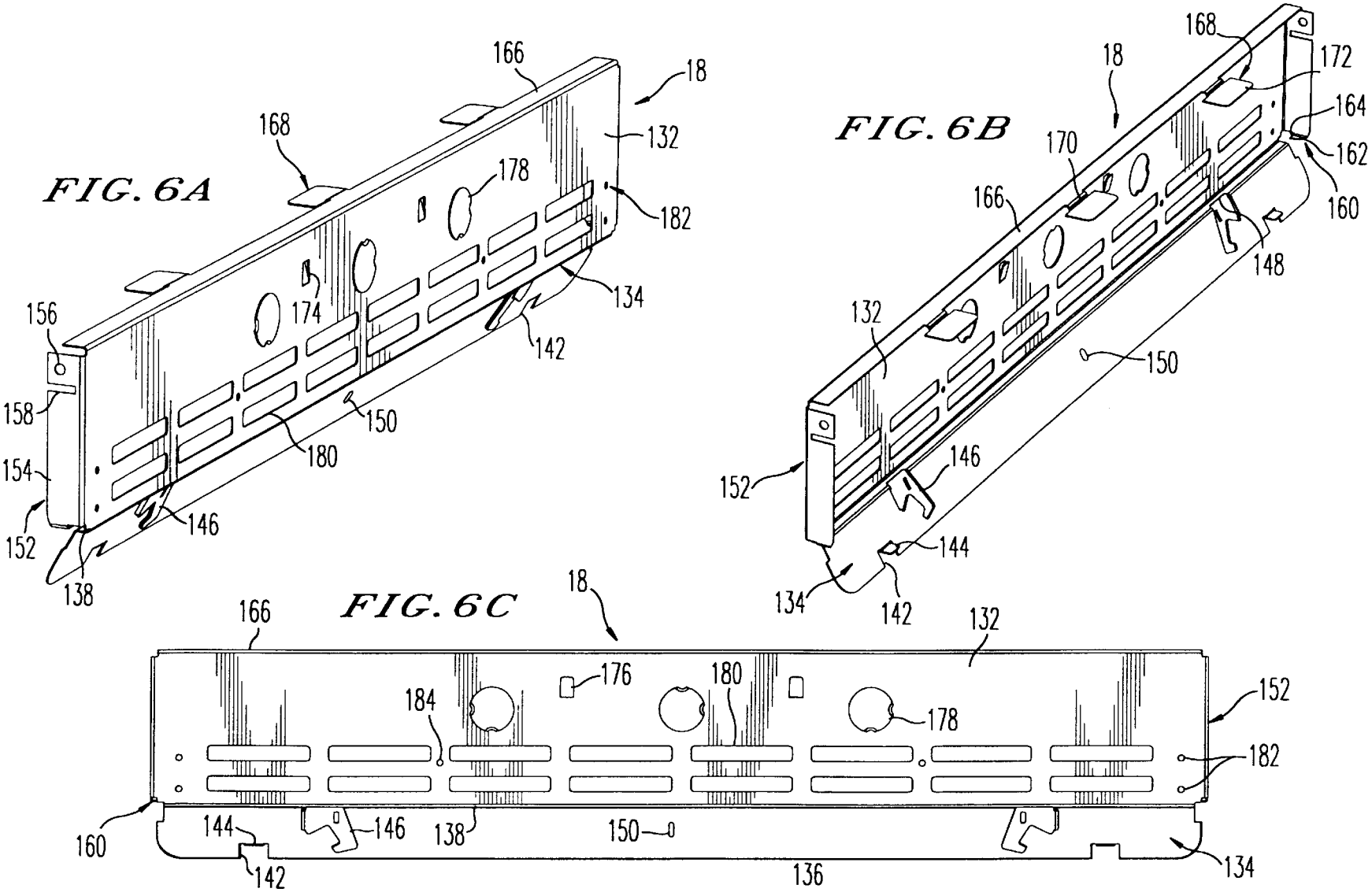
FIG. 6A is a perspective view of an end plate of the invention taken from a location above and toward an end thereof.
FIG. 6B is a perspective view of the end plate of FIG. 6A taken from the other side thereof.
FIG. 6C is a front elevational view of the end plate of FIG. 6A.
Figure 6D:
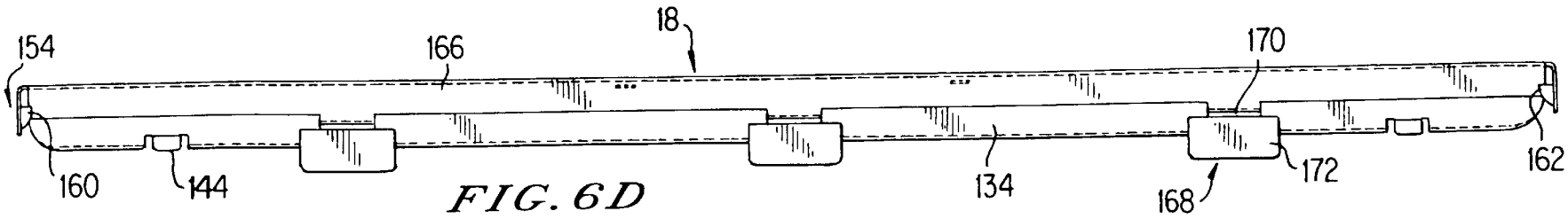
FIGS. 6D through 6F are detail views of portions of the end plate.
Figure 6F:
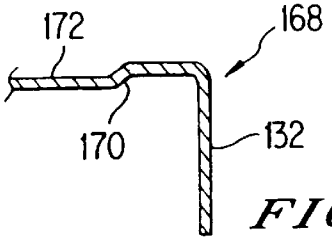
Figure 6E:
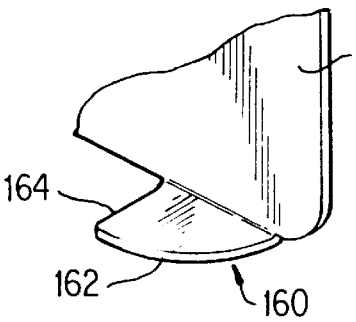
Figure 10A:
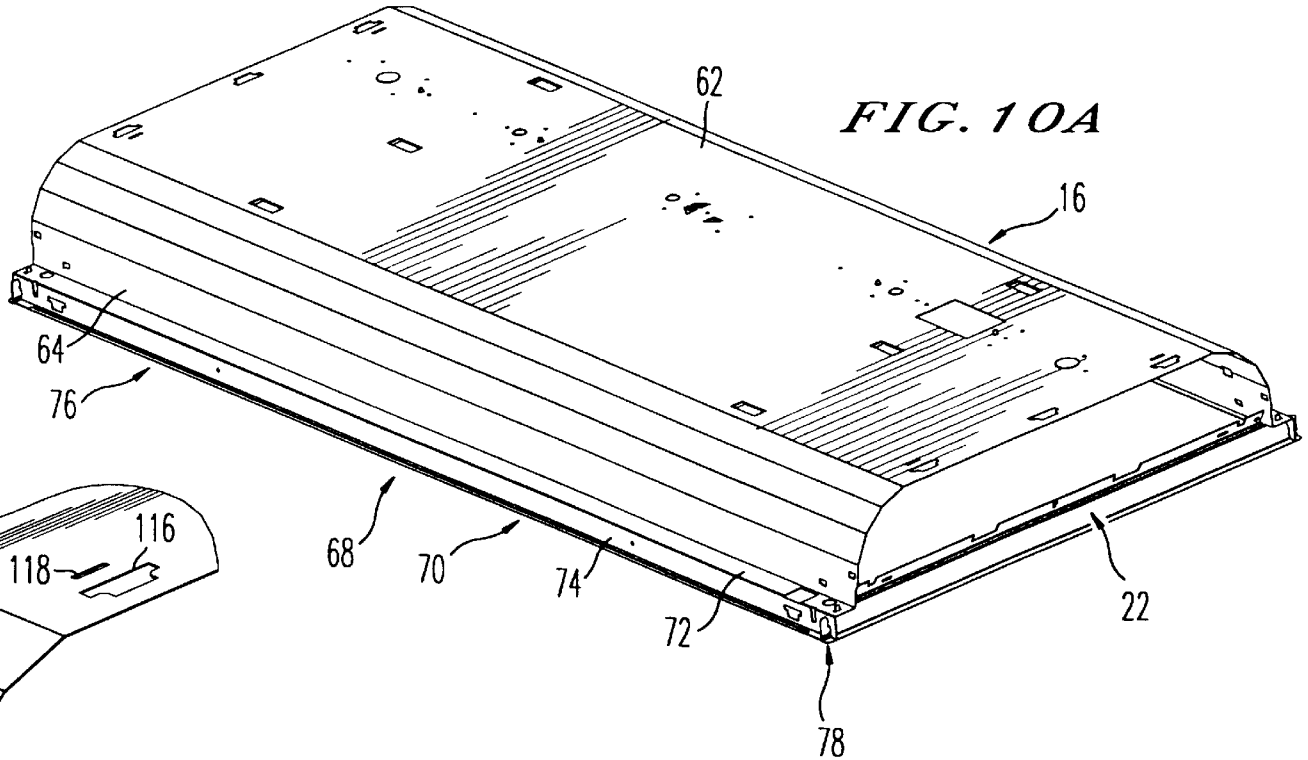
FIGS. 10A through 10C are perspective and detail views of the assembled relation of the side bar of FIG. 9 inclusive with the fixture housing.

As best seen in FIGS. 5 and 10A inter alia, the top wall 62 of the housing 16 is formed with a number of apertures of differing shape which cooperate with fastening structure formed on other component parts of the lighting fixture 10 so that said component parts can be fitted to and held onto the housing 16. The entire combination thus acts to form a rigid structure wherein the component parts of the fixture 10 including the housing 16 are positively secured together. At each end of the top wall 62, T-shaped apertures 116 are formed near outer edges of said top wall 62. Three of the T-shaped apertures 116 are located at each end of the top wall 62 and are spaced essentially equidistantly apart, leg portions of each of the apertures 116 extending toward respective ends of the housing 16. The T-shaped apertures 116 cooperate, as will be described hereinafter, with fastening structure formed on the respective end plates 18 and 20. Immediately inwardly of the two outermost apertures 116 at each end of the housing 16, slots 118 are formed which cooperate with fastening structure on the socket strips 26 and 28 as will be described hereinafter. Three punched straps 120 having longitudinal axes thereof parallel to the longitudinal axis of the housing 16 are each formed in two groupings inwardly of each grouping of the T-shaped apertures 116, a total of six of the three punched straps 120 being in the two groupings of the straps 120. The centrally disposed straps 120 essentially align with the central T-shaped aperture 116 while the outermost straps 120 are located slightly outside of longitudinally oriented imaginary lines drawn between respective outermost T-shaped aperture 116 at respective ends of the housing 16. The punched straps 120 act to mount the lamp channels 36, 38 in a manner which will be described hereinafter.

An inner wall portion of the top wall 62 which is covered by the lamp channel 36 has various openings formed therein including the tabs 110 and the apertures 112 and 114. Knock-outs 122 can also be located near either end of the housing 16 and covered by the lamp channel 36 in the event that access needs to be gained to the electronics and/or wiring structure such as the ballasts 106, 108. A relatively large rectangular access hole 124 is formed between two of the straps 120 and in the portion of the wall 62 covered by the lamp channel 36. A number of small circular apertures 128 are formed in various locations about the knock-outs 122, the aperture 124, the tabs 110 and the apertures 112 and 114. These circular apertures 128 function to mount accessories (not shown) to the top wall 62 in a conventional manner.

Referring again to the drawings and particularly to FIGS. 6A through 6F, the end plate 18 is seen in detail. Since the structure of the end plate 18 is essentially identical to the structure of the end plate 20, a description of only one of the end plates suffices for a description of both. It is to be understood that the end plates 18 and 20 form major functional portions of housing assembly 130, said housing assembly 130 effectively comprising the major mechanical portion of the lighting fixture 10. In essence, the housing assembly 130 is defined as comprising that mechanical portion of the fixture 10 with the exception of the louver 12 and the light trap and louver mounting assembly 14, that is, the housing 16, the end plates 18, 20 and the side bars 22, 24. The socket strips 26, 28 and the lamp channels 36, 38 mount to the housing assembly 130 and can be considered to be secondary portions thereof.

The end plate 18 is seen to be formed of a single sheet of material such as steel which is painted after forming. The end plate 18 essentially comprises a rectangular body portion 132 having an angled apron 134 integrally formed therewith along a lower lateral edge of said body portion 132. The apron 134 is also formed of a substantially rectangular body portion 136 connected to the body portion 132 by means of a slightly angled flange element 138. The body portion 136 is rounded at respective ends and has a notch 140 formed at either end thereof interiorly of the rounded ends, the respective notches 140 extending through the flange element 138 and essentially being defined by outer lower edges respectively of the rectangular body portion 132. Rectangular notches 142 are cut out of the apron 134 at locations spaced from the rounded edges of the apron 134, the notches 142 being open along lowermost lateral edges of said apron 134. A rectangular tab 144 extends one each from each one of the notches 142. The tabs 144 are spaced on either side thereof from opposing vertical edges of said notches 142. The tabs 144 extend upwardly from the plane of the apron 134 and essentially inwardly of the housing assembly 130. The tabs 144 are received by cooperating structure formed in the side bar 22 (the side bar 24 in the case of the end plate 20) as will be described hereinafter.

Immediately inwardly of the notches 142 hanger elements 146 are punched from the body portion 136 of the apron 134, said hanger elements 146 remaining in the plane of the body portion 136 unless pushed outwardly of the end plate 18 to mount to a suspended ceiling structure such as a T-bar grid (not shown) of conventional design. The hanger elements 146 remain connected to the end plate 18 only through the agency of respective neck portions 148, it being a simple matter to bend the hanger elements 146 at the neck portions 148 to position said hanger elements 146 to allow accomplishment of a conventional function. An oval aperture 150 is formed substantially centrally of the apron 134 between the hanger elements 146.

The end plate 18 is provided at either end of the body portion 132 with end flanges 152 which are substantially identical to each other. Each of the end flanges 152 is formed of a rectangular body portion 154 formed integrally with the end plate 18 and turned inwardly at right angles to the body portion 132. Each of the end flanges 152 have a circular aperture 156 located near an upper edge thereof with a narrow rectangular notch 158 being formed immediately below the circular aperture 156, the notch 158 being open toward the interior of the housing assembly 130 when said end plate 18 is mounted to said housing 16. An arcuate tab 160 is formed at the end of the body portion 154 opposite that end in which the circular aperture 156 is formed. The arcuate tab 160 has an arcuate edge 162 and a shoulder 164. The edge of the tab 160 defining the shoulder 164 is essentially perpendicular to the plane of the end flange 152. The arcuate tabs 160 act to facilitate fastening of the end plate 18 by being received into the apertures 102 formed in the housing 16. FIG. 7D particularly illustrates the location of one of the tabs 160 moving toward a corresponding one of the apertures 102 as the end plate 18 is fitted to the housing 16. FIGS. 8A and 8B show certain of the tabs 160 fitted into respective ones of the apertures 102, this structure acting to facilitate mounting of the end plate 18 (and the end plate 20) to the housing 16. The arcuate edge 162 of the tab 160 facilitates snap-fitting of the tab 160 into the aperture 102, the shoulder 164 of the tab 160 then fitting into place and biasing against a portion of that wall structure of the housing 16 which surrounds and defines the aperture 102.

A top flange 166 is formed along upper longitudinal edge of the body portion 132 of the end plate 118. The top flange 166 is essentially rectangular in conformation and extends inwardly from the body portion 132 essentially at a right angle thereto. T-shaped locking tabs 168 extend from the top flange 166 inwardly of the end plate 18, the locking tabs 168 being identical in structure. In the lighting fixture 10, three of locking tabs 168 are adequate to accomplish the locking function intended, the middle locking tab 168 being located substantially centrally of the end plate 18 with the two outer locking tabs 168 being substantially equally spaced from the locking tab 168 disposed centrally of said plate 18. Each of the locking tabs 168 connects to the top flange 166 by means of an angled neck 170 which extends at an angle downwardly from said top flange 166 and inwardly of the end plate 18. The neck 170 of each of the locking tabs 168 is reduced in length relative to rectangular tab elements 172, each of the tab elements 172 being substantially planar with the plane of each of the tab elements 172 being angled slightly downwardly from the plane in which the top flange 166 lies.

Figure 7A:
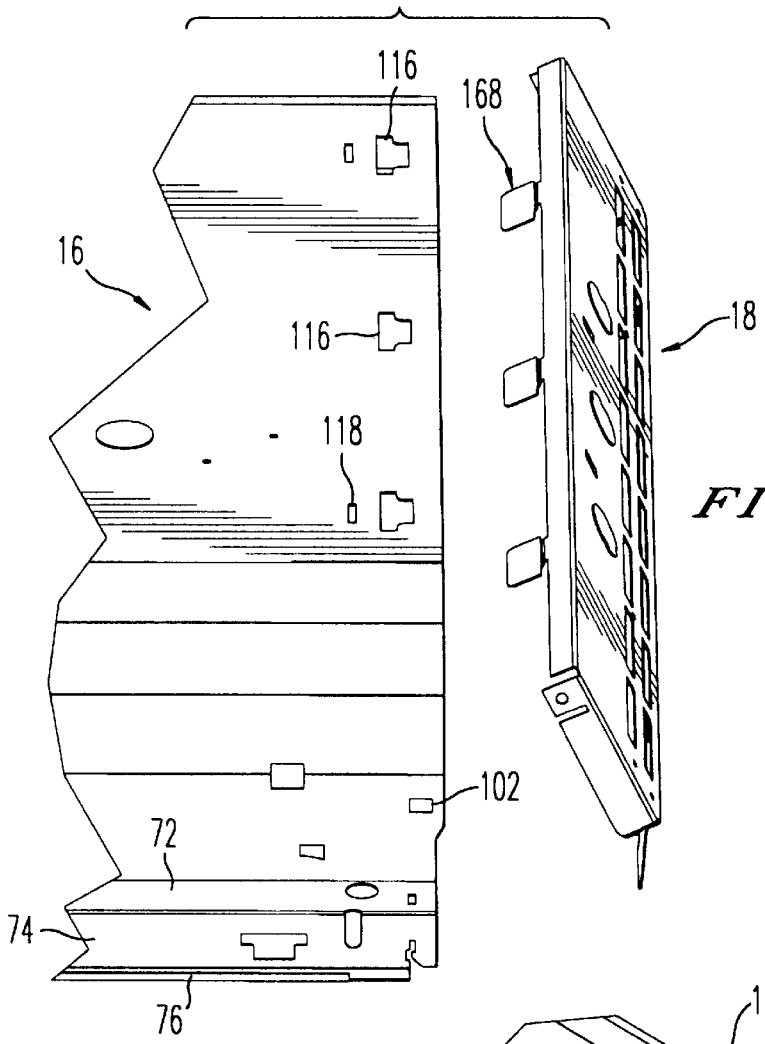
FIGS. 7A through 7D are detail perspective views illustrating mounting of the end plate to the fixture housing.
Figure 7B:
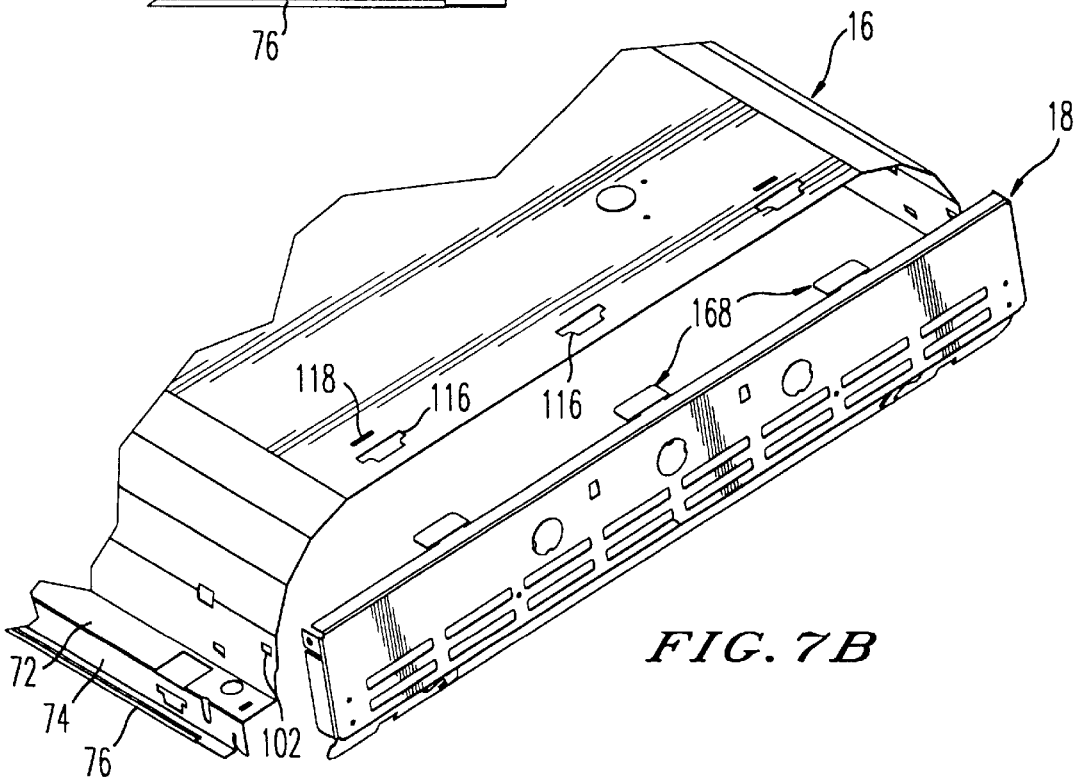
Figure 7C:
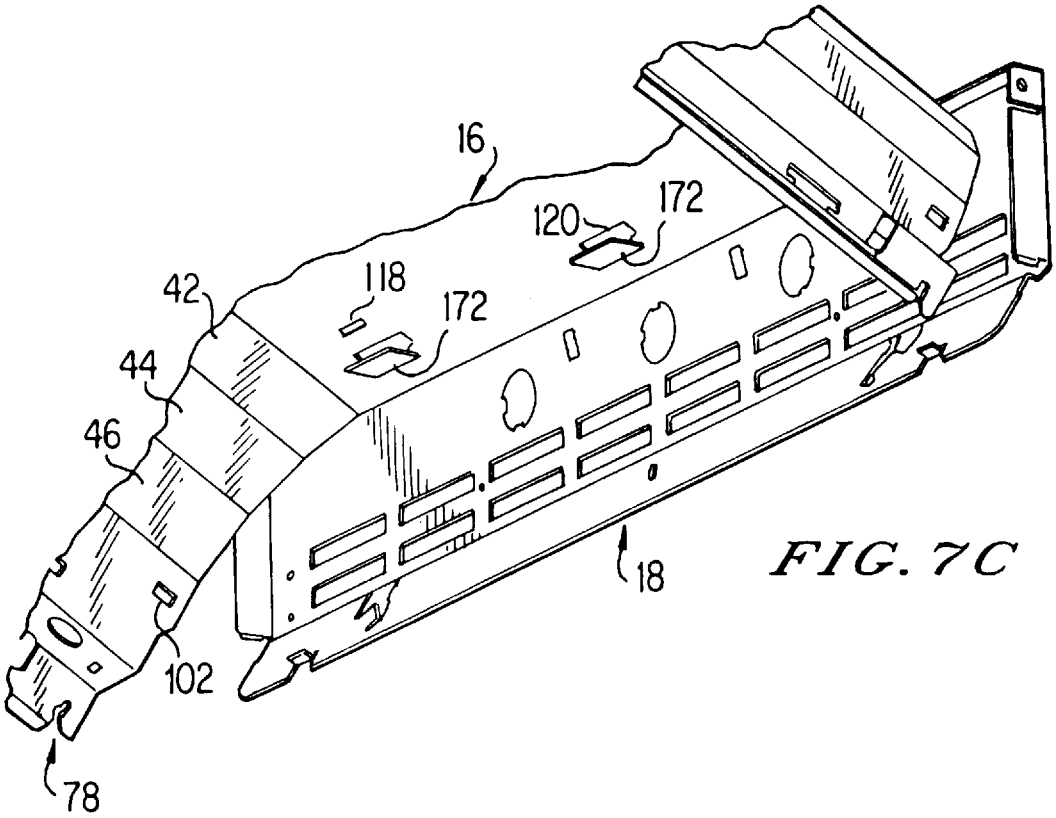
Figure 7D:
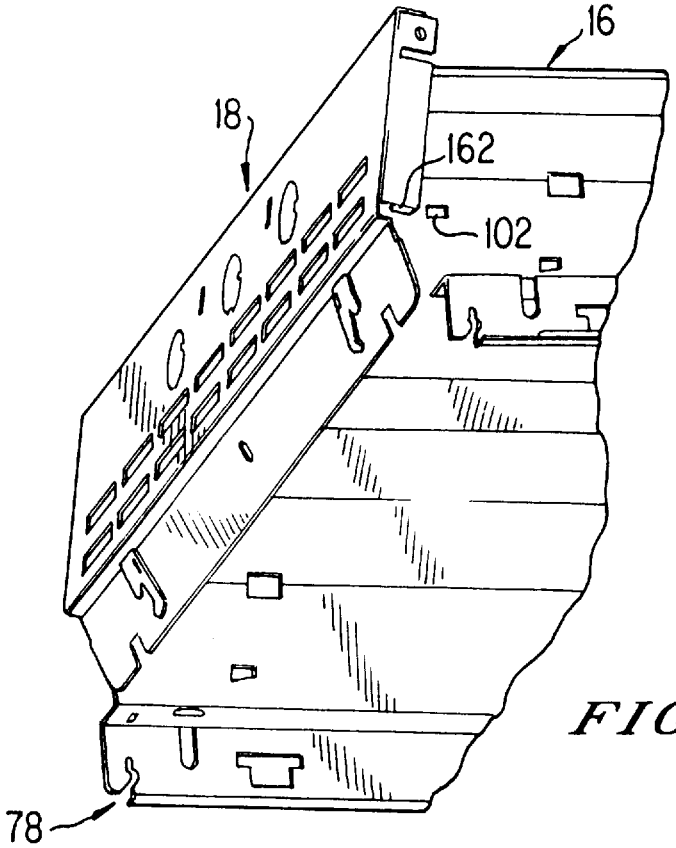
Figure 8A:
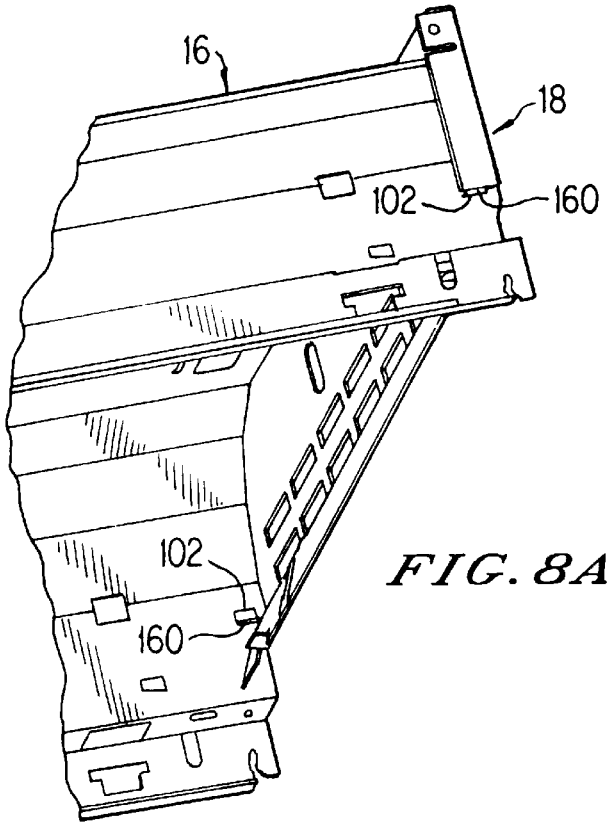
FIGS. 8A and 8B are detail perspective views of the end plate and the fixture housing in an assembled relationship.
Figure 8B:
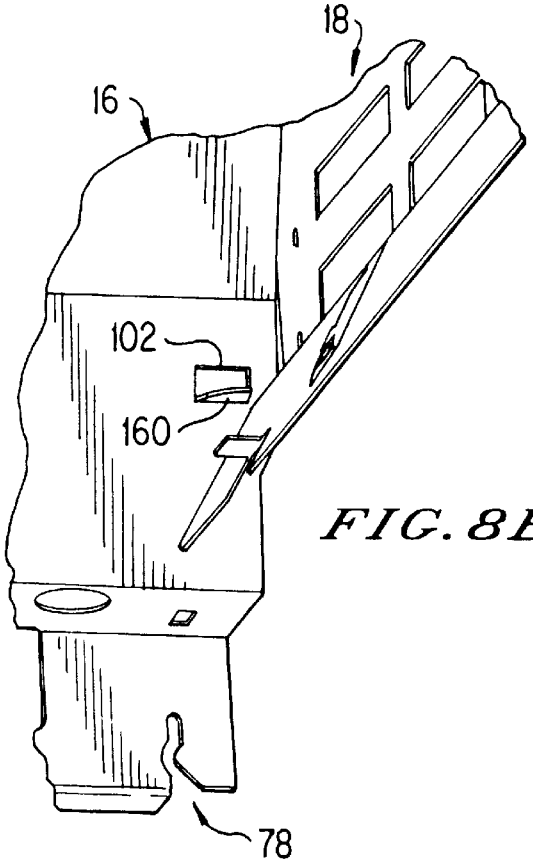
Figure 9A:
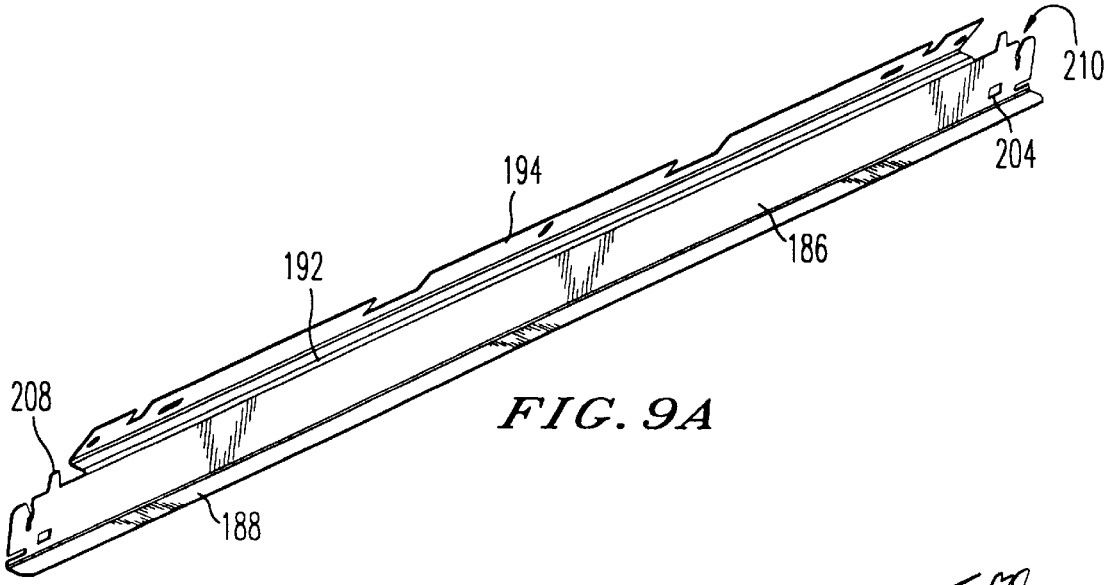
FIGS. 9A through 9F are perspective and detail views of a side bar.
Figure 9B:
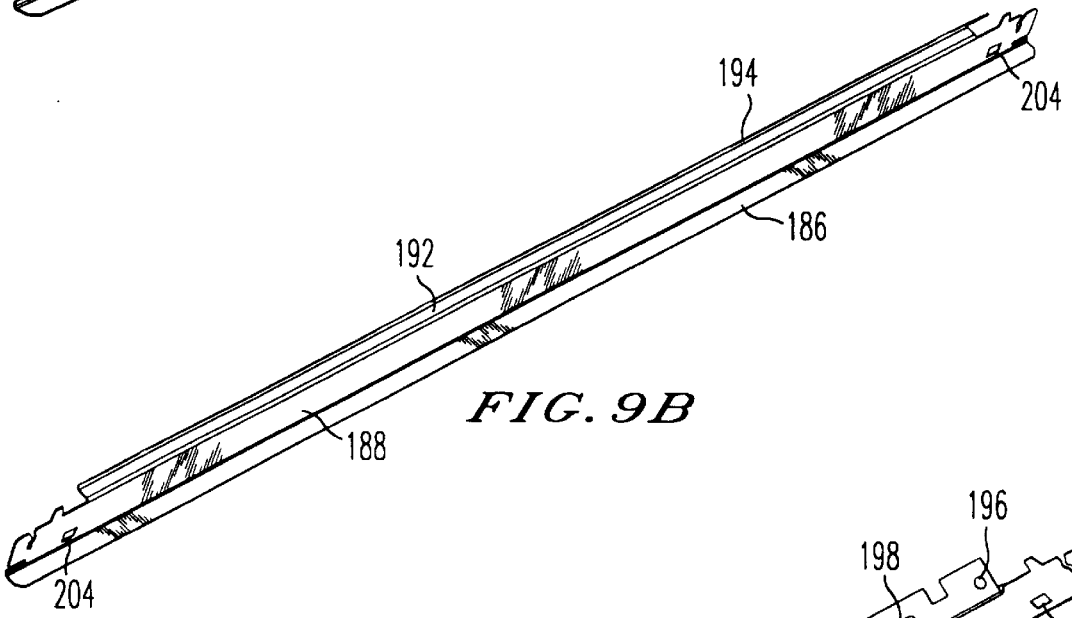
Figure 9C:
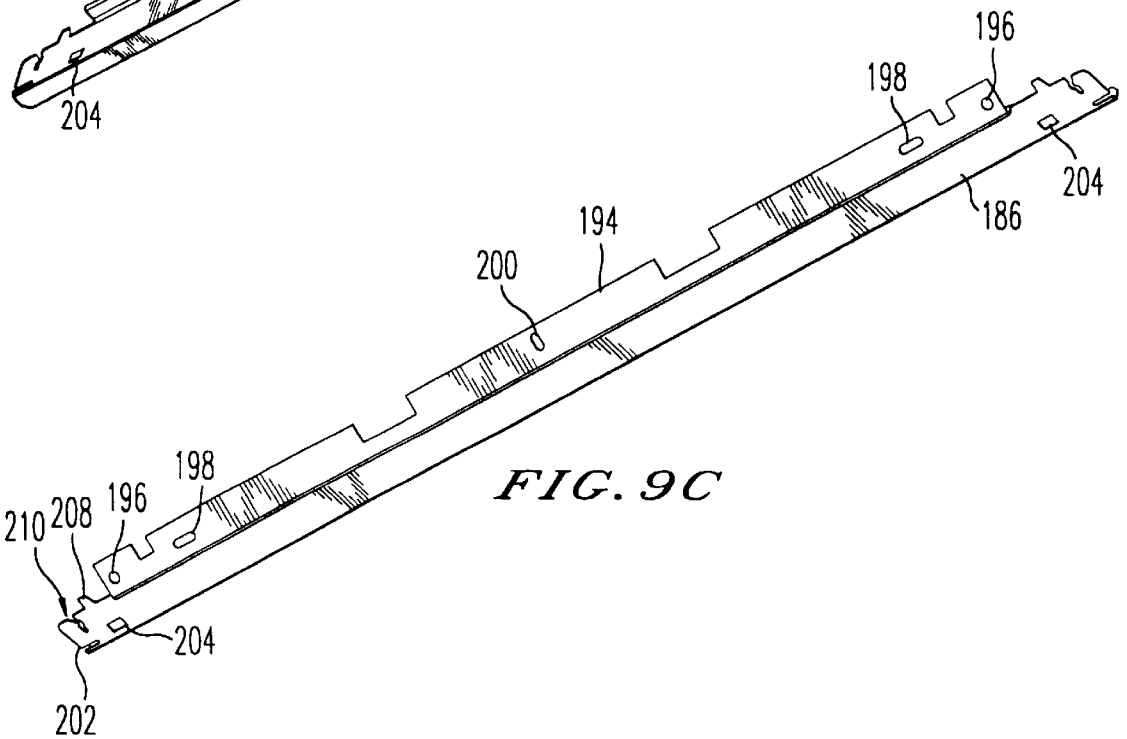
Figure 9D:
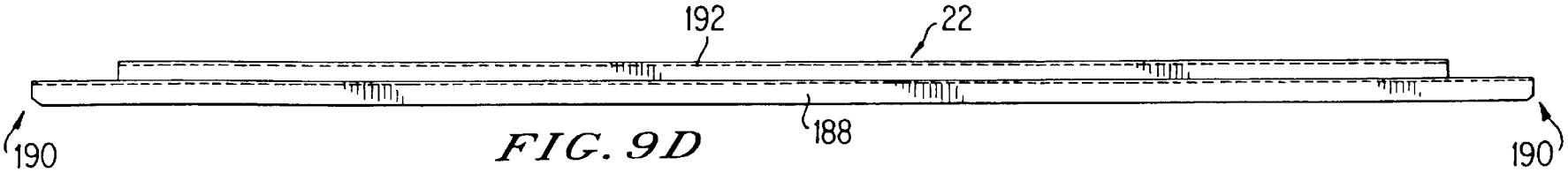
Figure 9E:
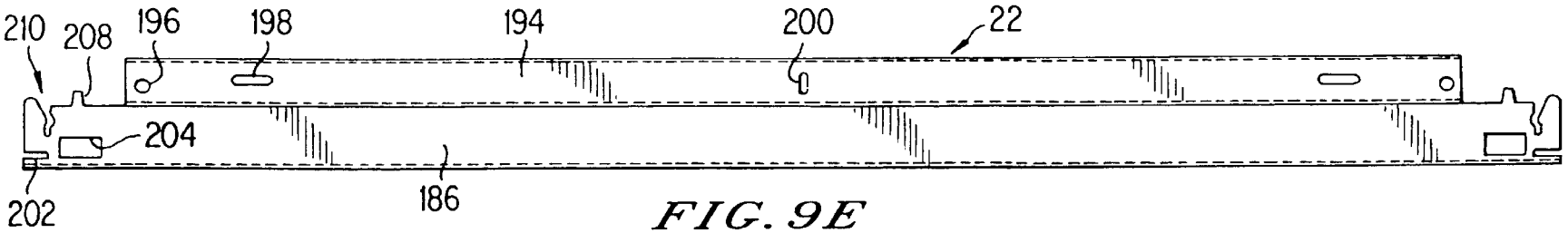
Figure 9F:
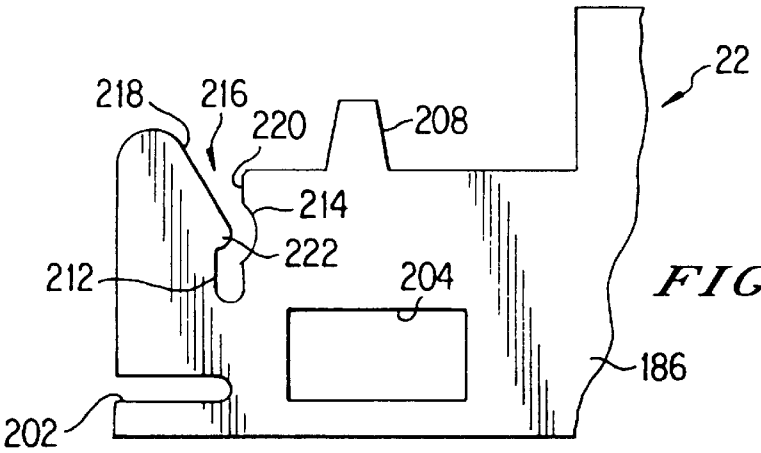

As is best seen in FIGS. 7A through 7D, the T-shaped locking tabs 168 are received into the T-shaped apertures 116 formed in the housing 16, the apertures 116 being shaped at the cross portion thereof to receive the respective tab elements 172 with the angled neck 170 of each of the tabs 168 being received into the corresponding leg portion of the T-shaped apertures 116 from a direction above the top wall 62 of the housing 16. As best seen in FIGS. 7C and 7D, the end plate 18 is then rotated inwardly to seat the tabs 166 and also bring the arcuate tabs 160 on the end flanges 152 into engagement with the apertures 102 formed in the housing 16, the end plate 18 thus being snap-fit to the housing 16. The locking tabs 168, due to resiliency provided by the angled neck 170 inter alia, exert tension between the end plate 18 and the housing 16 to facilitate attachment of said end plate 18 to said housing 16.

Figure 13C:
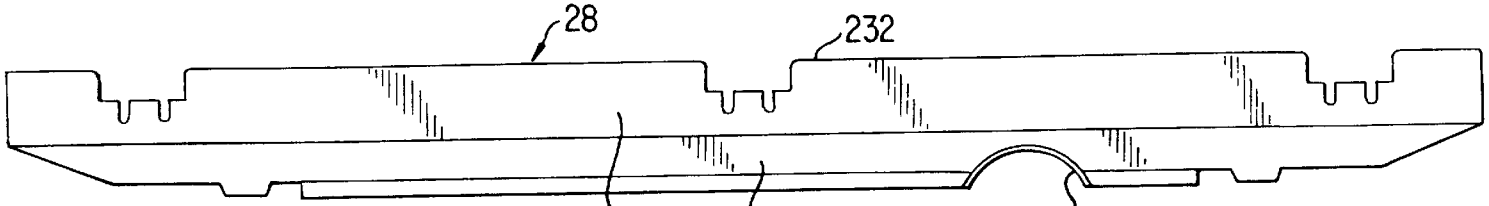
FIG. 13C is a side elevational view of a socket strip according to the invention.
Figure 13A:
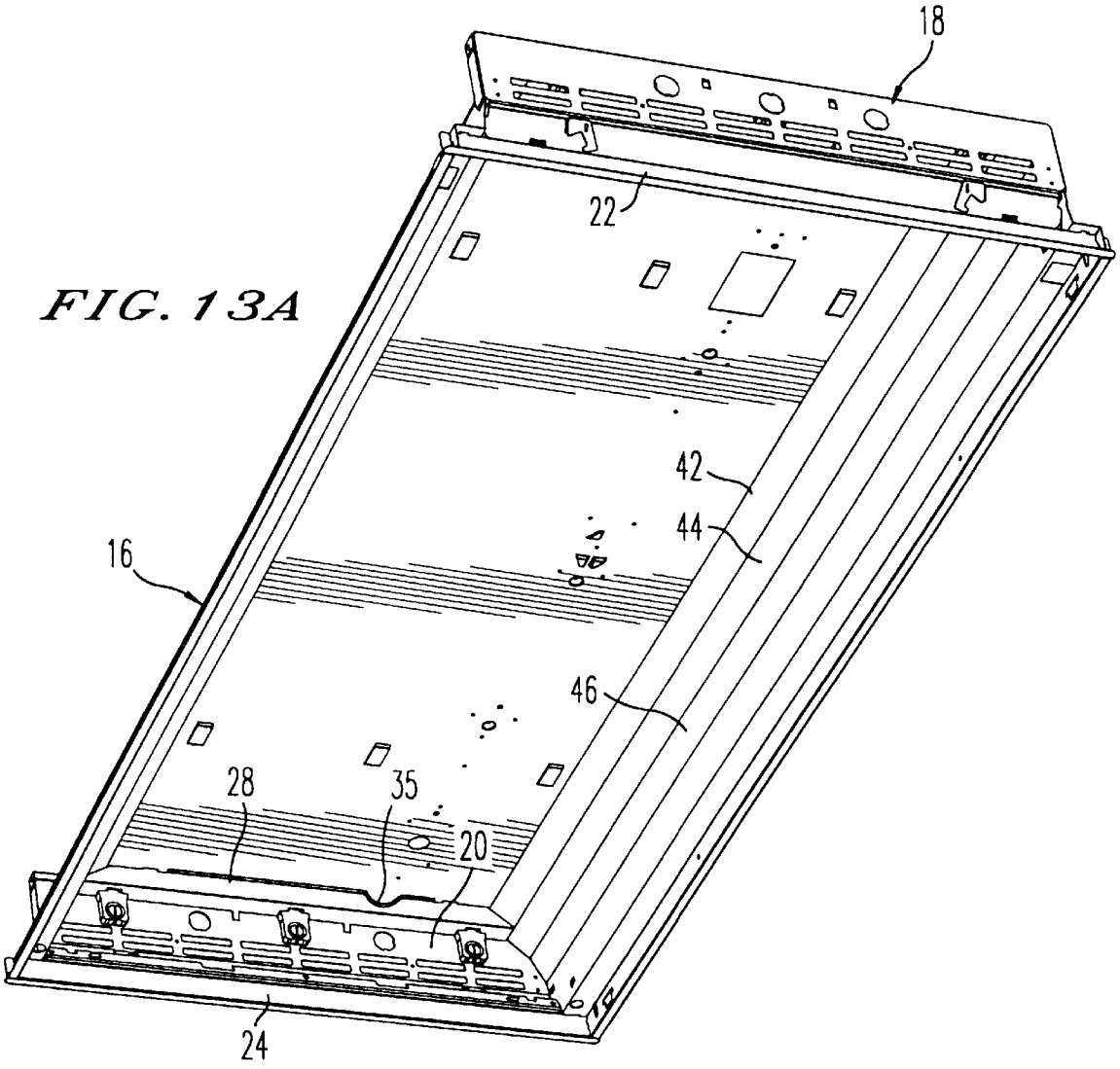
FIGS. 13A and 13B are perspective views of the assembled relationship of structural portions of the fixture including mounting of an internal socket strip to the housing of the fixture and taken from below the fixture.
Figure 13B:
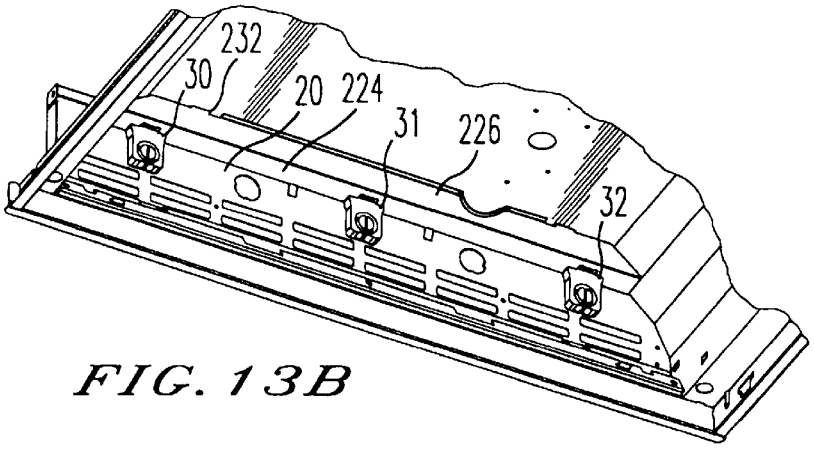

Immediately below the central locking tab 168 and to either side thereof, U-shaped cutouts 174 are formed in the body portion 132 of the end plate 18. The rectangular piece of material disposed interiorly of each of the U-shaped cutouts 174 comprises a tension tab 176 which is bent slightly inwardly of the end plate 18, the tension tabs 176 biasing against upper portions of the socket strip 26 as is best seen in FIGS. 13A and 13B. FIG. 13C illustrates the socket strip 28. The tensioning provided by the tension tabs 176 further acts to hold the housing assembly 130 in tension and to maintain a positive securement and thus a desired rigidity of said housing assembly 130. The end plate 18 is further provided with a series of knock-outs 178 which can be utilized in the event that electrical wiring (not shown) or other structure is to be inserted into the interior of the lighting fixture 10 through the end plate 18. The end plate 18 is further provided with a series of slots 180 which function to ventilate the interior of the lighting fixture 10 and thus to remove heat. It is to be understood that the slots 180 can be provided in patterns other than the pattern explicitly shown in the drawings. A pair of circular apertures 182 are formed near each lowermost corner of the body portion 132 and function to mount clips (not shown) which are required by code in areas having earthquake activity. Apertures 184 are formed inwardly of the body portion 132 and function to mount damper structure (not shown) used in some installations to damp air flow. FIGS. 7 inclusive and 8 inclusive are thus seen to respectively illustrate details of the mounting of the end plate 18 to the housing 16 and the actual assembly of said plate 18 to the housing 16. FIGS. 8A and 8B particularly illustrate the assembled relationship of the plate 18 and the housing 16 with the arcuate tabs 160 of the plate 18 being received into the slots 102 of the housing 16.

Figure 10B:
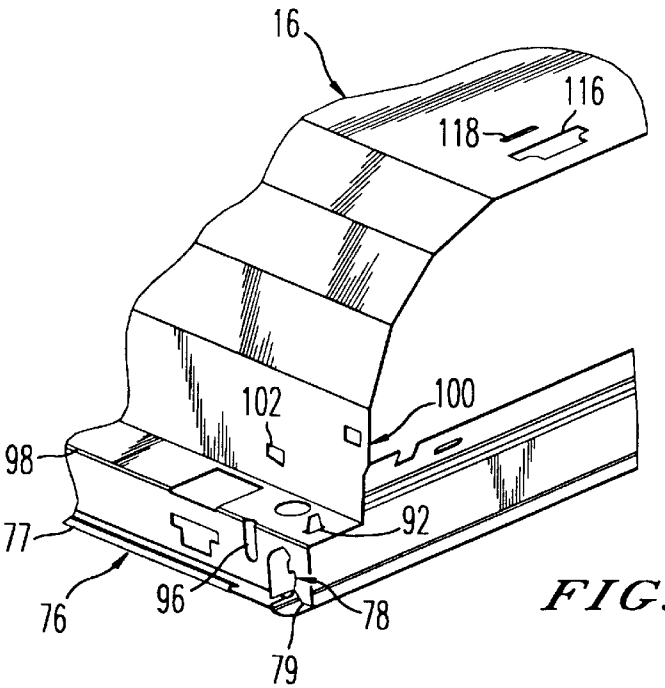
Figure 10C:
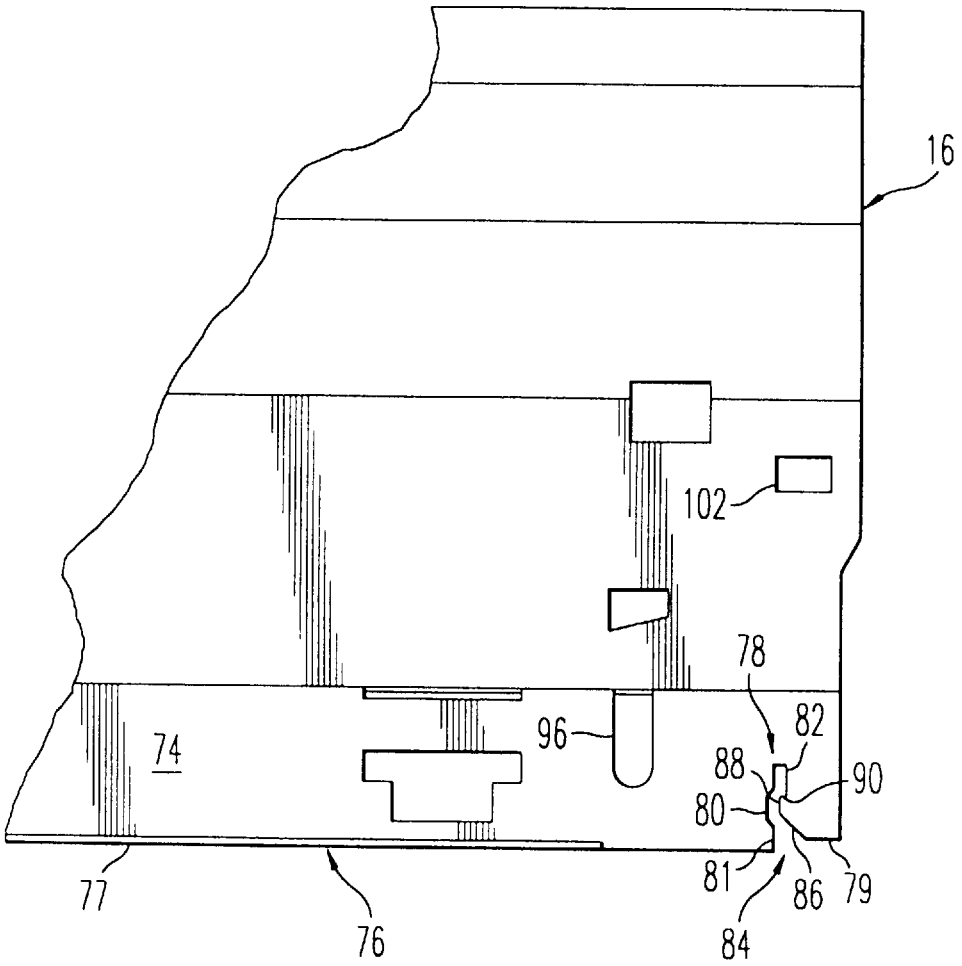
Figure 11A:
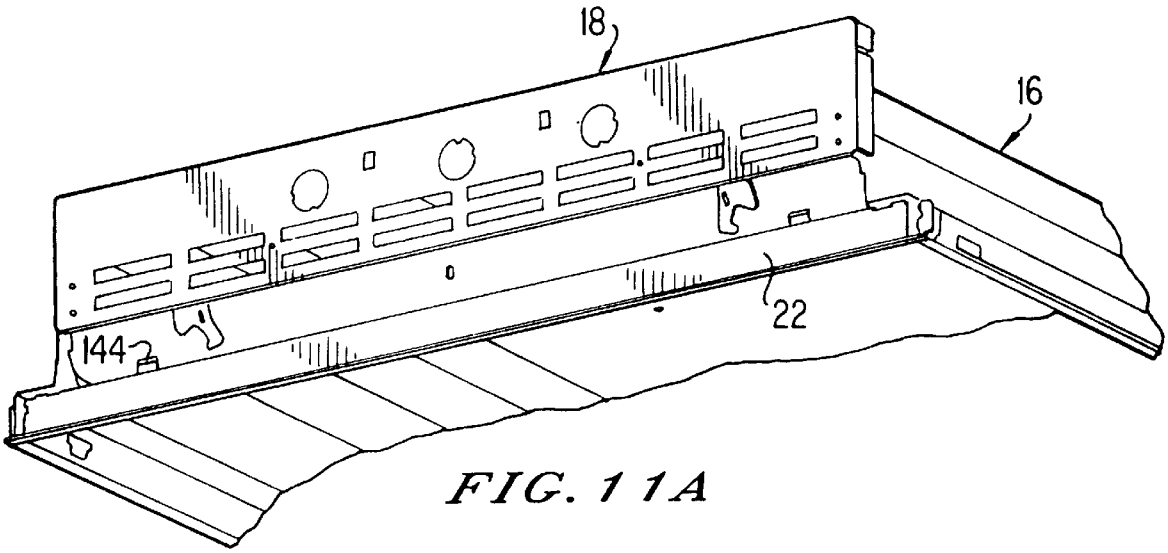
FIG. 11A and 11B are perspective views of the assembled relationship of the side bar and the end plate with the fixture housing taken from outside of the housing.
Figure 11B:
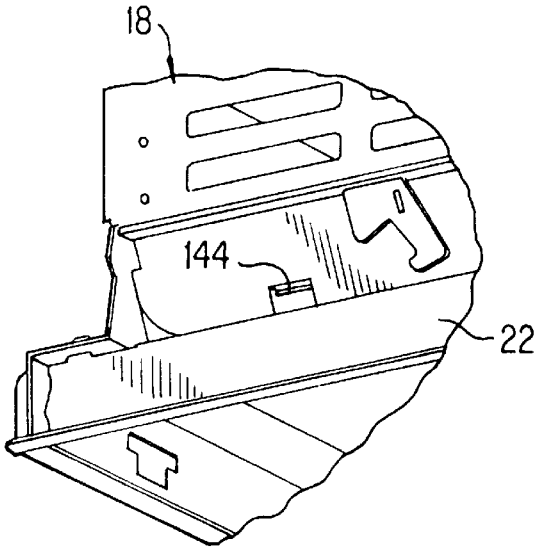
Figure 12A:
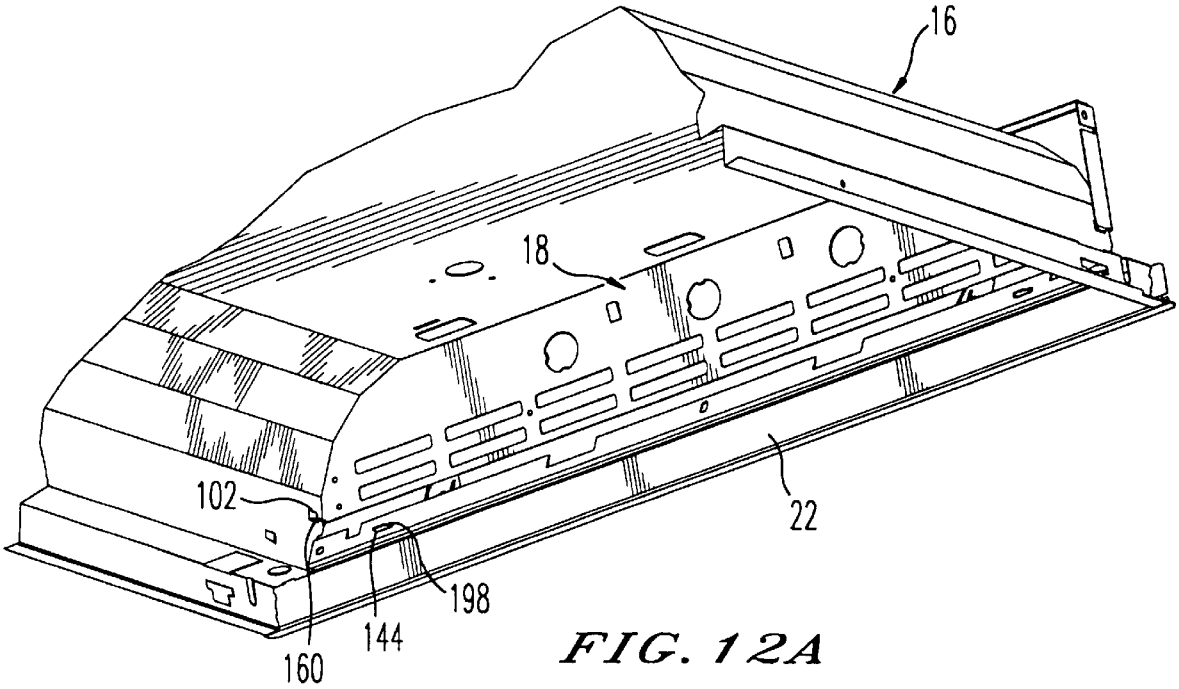
FIGS. 12A and 12B are perspective views of the assembled relationship of the side bar and the end plate with the fixture housing taken from interiorly of the housing.
Figure 12B:
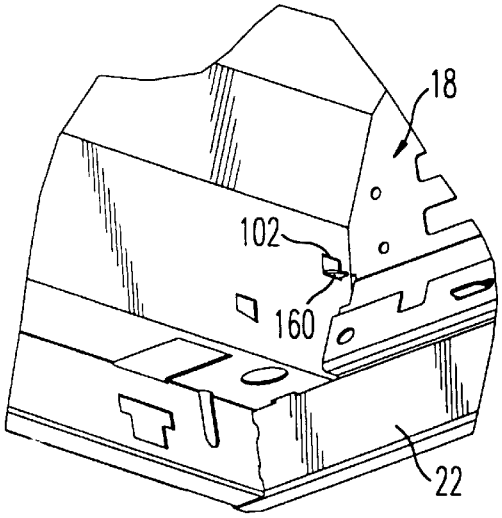

Referring now to FIG. 9 inclusive, the structure of the side bar 22 will now be discussed in detail. Since the side bar 22 is essentially identical to the side bar 24, a description of said side bar 22 suffices for a description of both. As seen particularly in FIG. 9 inclusive which comprises FIGS. 9A through 9F, the side bar 22 is seen to comprise an elongated planar body member 186 having a lateral flange 188 extending from said body member 186 along a lower longitudinal edge thereof, the lateral flange 188 being planar in conformation and extending essentially perpendicular from the plane of the body member 186 and in a direction inwardly of the housing assembly 130 when the side bar 22 is assembled to the housing 16 (as seen in FIG. 10 inclusive). Distally disposed corners 190 of the lateral flange 188 are cut away. The upper longitudinal edge of the body member 186 has a planar elongated web 192 which is of a length less than the length of the flange 188 and which extends slightly upwardly and outwardly of the planar body member 186. The web 192 is disposed centrally of the upper edge of the body member 186 and along substantial portions of the length thereof. The web 192 recurves along its outer edge to form an upper flange 194, the upper flange 194 extending along the full free edge of the web 192. The plane in which the upper flange 194 lies is disposed at an angle relative to the plane of the web 192 and also to the plane of the body member 186 although at differing angles to said respective planes. The free upper edge of the flange 194 extends inwardly toward the extended plane in which the body member 186 lies and intersects said plane and extends slightly therethrough. The upper flange 194 is formed with circular apertures 196 located one each at each end of said flange 194. Inwardly of the circular apertures 196 are formed longitudinally extending slots 198. As is seen in FIGS. 12A and 12B, the tabs 144 formed on the end plate 18 are respectively received into each one of the slots 198 of the side bar 22 to further facilitate mounting of the end plate 18 to the side bar 22 and thus to the housing assembly 130. FIGS. 10A through 10C illustrate mounting of the side bar 22 to the housing 16 absent the end plate 18 in order that this relationship can be seen without the complication of the presence of the end plate 18. Referring again to FIG. 9 inclusive, an aperture 200 is formed centrally of the upper flange 194 and toward the free upper edge thereof, the aperture 200 functioning to align with the aperture 150 in the end plate 18 to receive a screw where code requires same.

The ends of the body member 186 of the side bar 22 are substantially mirror images of each other and the structure of one end of said body member 186 will suffice for a description of both. A rectangular notch 202 is formed in a lower portion of the body member 186 immediately above each end of the lateral flange 188. The notches 202 are open outwardly of the ends of the body member 186. Immediately inwardly of each notch 202 is formed a rectangular slot 204 which receives a portion of a resilient spring 206 (see FIG. 3) which comprises a component part of the light trap and louver mounting assembly 14. The resilient spring 206 acts to releasably lock the louver 12 and the light trap and louver mounting assembly 14 to the housing assembly 130 to form the lighting fixture 10. Further description of the structure and function of the resilient spring 206 is to be found in co-pending United States patent application Ser. No. 08/____filed of even date and assigned to the present assignee as aforesaid. A substantially V-shaped tab 208 having a blunted lower portion extends from the upper edge of the body member 186 near each end thereof and at that location at said ends of the body member 186 which are absent the web 192 and the upper flange 194. The tabs 208 fit into respective slots 92 formed in the horizontal flange 72 of the housing 16 to facilitate mounting of the side bar 22 to the housing 16 as can best be seen in FIG. 10 inclusive. Each of the tabs 208 are located above the respective slots 204 formed in the body member 186.

Outwardly of the tab 208 and the slot 204 is formed a shaped cut-out 210 which is similar to the shaped cut-out 78 formed in the vertical flange 74 of the housing 16. The shaped cut-out 210, in a manner similar to the structure of the shaped cut-out 78, is formed of apertures 212 and 214, the aperture 212 being disposed downwardly from the aperture 214, the apertures 212 and 214 sharing a common, imaginary edge along an upper side of said aperture 212. While similarly shaped as the apertures 80 and 82, the lower aperture 212 is slightly longer than the corresponding aperture 80 formed in the housing 16 with the aperture 214 being slightly smaller than the corresponding aperture 82. A V-shaped entry aperture 216 allows communication to the apertures 212 and 214 in the same manner as the V-shaped entry aperture 84 allows access to the apertures 80, 82 formed in the housing 16. The entry aperture 216 is defined partially by slanted edge 218 and vertical edge 220, the vertical edge 220 extending downwardly toward the aperture 212 with shoulder 222 defining a major portion of the upper edge of the aperture 212. It is to be understood that the side bars 22 and 24 are preferably formed of single pieces of material such as steel with said side bars 22, 24 being painted black to match the color of the L-shaped channel 70 inter alia of the housing 16 as well as the light trap and louver mounting assembly 14 for reasons indicated above.

As is best seen in FIGS. 10A through 10C, the side bar 22 is fitted to the housing 16 by interengagement of the shaped cut-out 78 of the housing 16 and the shaped cut-out 210 of the side bar 22. The respective cut-outs 78 and 210 interengage through the expedient of the V-shaped entry apertures 84 and 216 respectively such that the shoulders 90 and 222 respectively engage edges of the apertures 80 and 212, thereby to snap-fit the side bar 22 to one end of the housing 16. The side bar 24, which is of a construction identical to the side bar 22, is fitted identically to the other end of the housing 16. As seen in FIGS. 12A and 12B, fitting of the side bar 22 to the housing 16 causes the tabs 144 of the end plate 18 to respectively fit into the slots 198 formed in the upper flange 194 of the side bar 22, thereby further facilitating the snap-fitting assembly of the component parts of the housing assembly 130. The side bars 22 and 24 can also be readily disassembled from the housing 16 as can the end plates 18 and 20.

Referring yet again to the drawings and particularly to FIGS. 13A and 13B, the socket strip 28 is shown to be fitted to the housing 16. The socket strip 26 can be very similar in structure to the socket strip 28 with the exception that the socket strip 28 is best provided with only one cut-out 35 while the socket strip 26 is best provided with more than one cut-out (not shown) to facilitate handling of wiring (not shown). Accordingly, a description will be given of the socket strip 28 which will effectively suffice for a description of the socket strip 26. The socket strip 28 is formed of a planar mounting plate 224 having an angled apron 226 extending from an innermost edge of said plate 224. The sockets 30, 31 and 32 are conventionally mounted to the plate 224. The semi-circular notch 35 is formed in the outer edge of the plate 224 to allow wiring (not shown) to extend from the interior of the socket strip 28 and be received into the confines of the lamp channel 36 (note FIG. 14). Electrical power is supplied to the ballasts 106, 108 and thus to the lamps through this wiring in a known manner. The socket strip 26 can be provided with more than one notch which functions similarly to the notch 35. Notches (not shown) in the strip 26 are spaced apart to allow wiring to extend into the confines of the socket strip 26 and connect to the sockets 30, 31 and 32. Along the inner edge of each of the strips 26, 28, tabs 232 extend and are received into the slots 118 formed in the housing 16, thereby to facilitate mounting of the socket strips 26, 28 to said housing 16. It is to be understood that a number of different socket strip configurations exist which are suitable for use in the lighting fixture 10.

Figure 14:
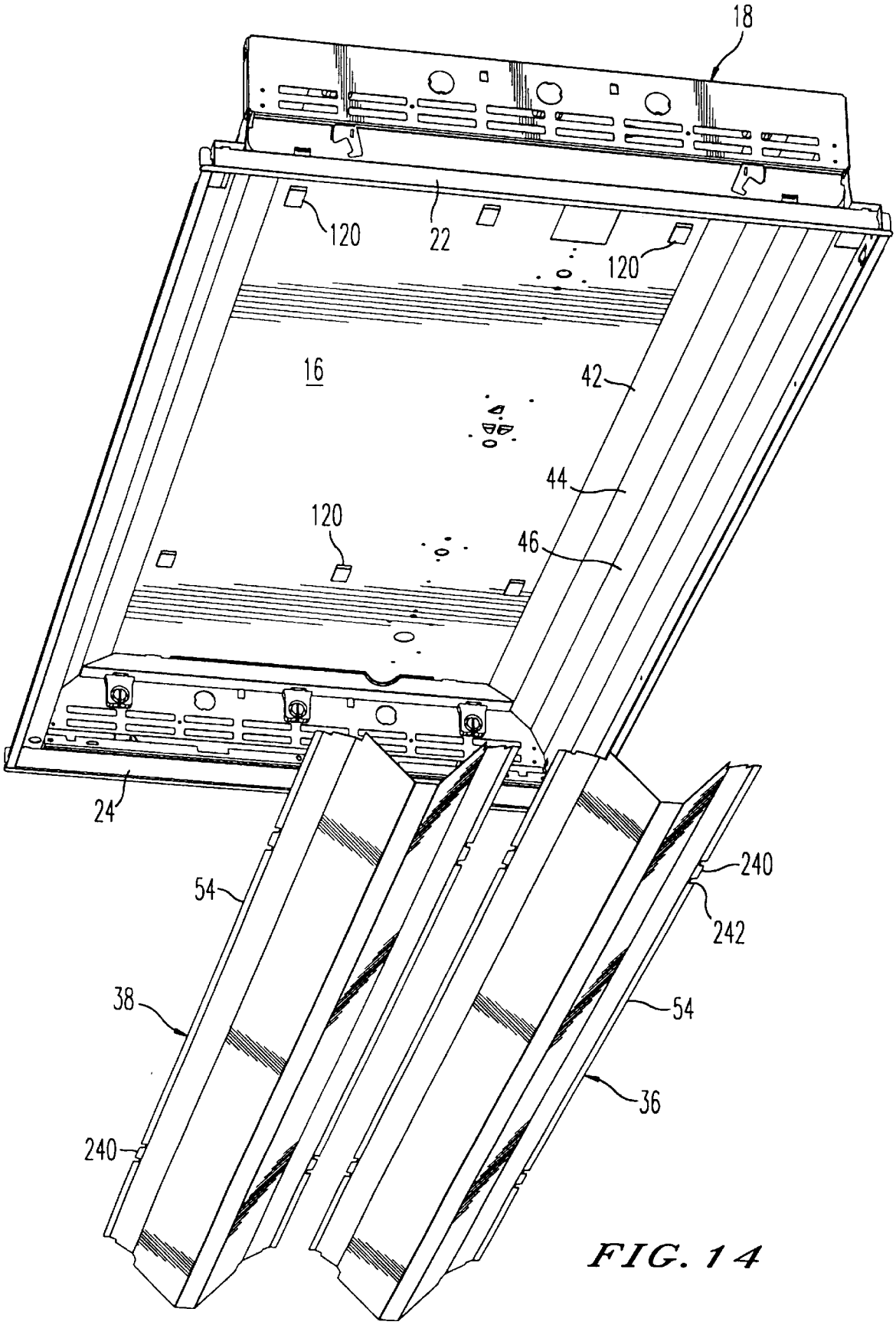
FIG. 14 is an exploded view of lamp channels of the invention in an assembly relationship to the housing of the fixture; and, FIG. 15 is a perspective view illustrating the assembled relationship of the lamp channels and housing.

Referring now to FIG. 14 inter alia, the lamp channels 36 are seen to be mounted to the housing 16 by means of tabs 240 formed respectively in contact edges 54 by the provision of notches 242 disposed on either side of each of said tabs 240. The tabs 240 extend slightly out of plane with the contact edges 54 and essentially upwardly toward inner wall surfaces of the top wall 62 of the housing 16. The tabs 240 fit respectively into openings formed by the punched straps 120, the channels 36, 38 being slightly deformed to facilitate fitting of the tabs 240 into engagement with the straps 120. The lamp channels 36, 38 are seen to be cut away at each corner to facilitate fitting of said lamp channels 36, 38 into place against inner surfaces of the top wall 62 of the housing 16.

Figure 15:
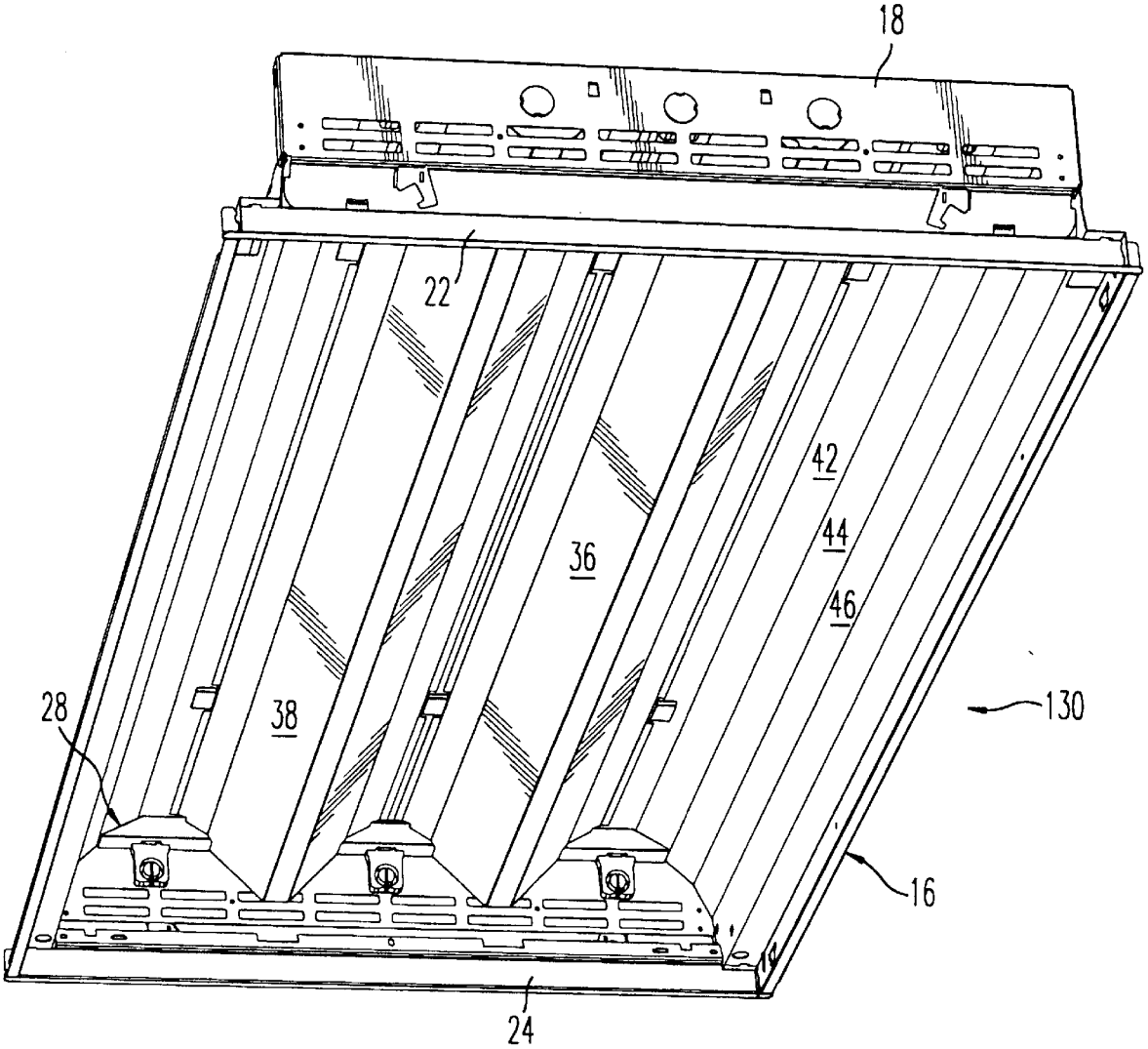

FIG. 15 illustrates the assembled relationship of the lamp channels 36, 38 and the housing 16, the structure shown in FIG. 15 essentially comprising the housing assembly 130.

It is to be understood that the lighting fixture 10 can be configured other than as explicitly shown in the drawings and described herein without departing from the scope of the invention which is defined by the appended claims.

What is claimed is:

1. A lighting fixture having at least one lamp carried within the lighting fixture, comprising:

a housing having a top wall formed on at least one end thereof, the top wall having at least one aperture formed therein near said end of said housing, the housing further being provided with side walls depending from the top wall and having at least one aperture formed in each of the side walls;

at least one end plate mounted to each end of the housing; and, means formed integrally with each of the end plates for mounting each end plate to the housing, said means comprising at least one tab element receivable within the aperture formed in the top wall of the housing, and further comprising at least one tab element receivable into the aperture formed in each side wall to snap-fit thereinto, thereby to retain each end plate to one each of the ends of the housing without the use of separate fastening elements.

2. The lighting fixture of claim 1 and further comprising:

at least one side bar mounted across opposing side walls of the housing on at least one end of said housing, each side bar having a slot formed in at least one end of each side bar; and, means formed integrally with each side bar for mounting said side bar to the housing, the means formed integrally with each end plate further comprising at least one tab carried by the end plate and which snap-fits into one each of the slots on assembly of the side bar to the housing.

3. The lighting fixture of claim 2 wherein each of the side bars is formed with a shaped cut-out in at least one end thereof and the housing has at least one vertical flange extending from at least one side wall on at least one end of the housing, the vertical flange having a shaped cut-out formed therein, the shaped cut-out formed in the side bar and the shaped cut-out formed in the housing being open-ended, the shaped cut-outs being mutually received each thereinto to connect said side bar to said housing.

4. The lighting fixture of claim 2 wherein each of the side bars is formed with a slot at each end thereof, the lighting fixture further comprising:

a louver; and, light trap and louver assembly means for carrying the louver and having a resilient spring fitted onto corners thereof along one side thereof, a portion of each of the resilient springs being biased into an opposing one of the slots formed in the side bars on placement of the light trap and louver assembly means in juxtaposition to the housing to latch the light trap and louver assembly means to the housing.

5. The lighting fixture of claim 4 wherein the resilient spring has a thumb element integrally formed therewith which when biased by manual pressure causes that portion of the resilient spring received into one of the slots to be biased outwardly of the slot to release the light trap and louver assembly means from the housing.

6. The lighting fixture of claim 4 and further comprising lamp channel means mounted to inner surfaces of the top wall of the housing for continuing parabolic cell shapes of the louver into upper portions of the interior of the housing.

7. The lighting fixture of claim 6 and further comprising means formed integrally with the lamp channel means for mounting said lamp channel means to inner surfaces of the top wall of the housing.

8. The lighting fixture of claim 7 wherein the means for mounting the lamp channel means comprises tab elements formed on each side of the lamp channel means, the housing having integral straps formed in the top wall of the housing, the straps extending into the interior of the housing, the tab elements formed on the lamp channel means being mounted by the straps to mount the lamp channel means to the housing.

9. The lighting fixture of claim 6 wherein the housing is provided internally at the juncture between the top wall and the side walls with reflective means for continuing parabolic cell shapes of the louver into upper portions of the interior of the housing.

10. The lighting fixture of claim 6 wherein a coating which is more reflective than a coating formed on other major portions of interior surfaces of the housing is formed on surfaces of the lamp channel means which oppose the at least one lamp.

11. The lighting fixture of claim 9 wherein a coating which is more reflective than a coating formed on other major portions of interior surfaces of the housing is formed on surfaces of the reflective means which oppose the at least one lamp.

12. The lighting fixture of claim 1 and further comprising:

at least one lamp holder socket strip disposed on at least one end of the housing;

holder means mounted to the socket strip for mounting the at least one lamp; and, tab means formed on at least one edge of the socket strip, the housing having at least one aperture formed in the top wall thereof and receiving the tab means to position the socket strip at the end of the housing.

13. The lighting fixture of claim 12 wherein each end plate is formed with tension tab elements integrally formed therein, the tension tab elements biasing against surface portions of the socket strip on assembly of the end plate to the housing, thereby to maintain the socket strip in place within the housing.

14. The lighting fixture of claim 4 wherein the side walls of the housing are formed with a slot formed in at least corners disposed along one side of the housing, the light trap and louver assembly means having a hook element located at least corner thereof along one side thereof, each hook element being received into an opposing one of the slots formed in the housing on placement of the light trap and louver assembly means in juxtaposition to the housing to allow pivoting of the light trap and louver assembly means relative to the housing for connection of said light trap and louver assembly means to the housing.

15. The lighting fixture of claim 1 wherein each end plate comprises a planar body portion and a planar apron portion formed integrally together along an integral connecting flange element, the planar apron portion being angled relative to the planar body portion, the planar body portion having a top wall flange and side wall flanges formed integrally along a top edge and side edges respectively thereof, the top wall flange carrying the at least one tab element which is receivable into the at least one aperture formed in a top wall of the housing, the aperture formed in the top wall of the housing having a T-shape with a leg portion thereof extending toward the end of the housing and a slot portion terminating the T-shape, the tab element having a reduced-in-length neck portion extending downwardly from the top wall flange and a rectangular plate element terminating the tab element and being co-planar with that plane within which the top wall flange lies, the tab element being essentially resilient in a vertical direction, the plate element being received into the slot portion of the aperture from outwardly of the housing and the neck portion of the tab element fitting into the leg portion of said aperture.

16. The lighting fixture of claim 1 wherein each end plate comprises a planar body portion and a planar apron portion formed integrally together along an integral connecting flange element, the planar apron portion being angled relative to the planar body portion, the planar body portion having a top wall flange and side wall flanges formed integrally along a top edge and side edges respectively thereof, each side wall flange of each end plate carrying one of the tab elements which is receivable into one of the apertures formed in each end of each of side walls of the housing, the tab elements having an arcuate edge and a shoulder terminating the arcuate edge, the arcuate edge facilitating snap-fastening of the tab element into said aperture and the shoulder providing an edge which engages a portion of the side wall of the housing defining said aperture, thereby to fasten the end plate to the housing.

17. The lighting fixture of claim 15 wherein each side wall flange of each end plate carries one of the tab elements which is receivable into one of the apertures formed in each end of each of side walls of the housing, the tab elements having an arcuate edge and a shoulder terminating the arcuate edge, the arcuate edge facilitating snap-fastening of the tab element into said aperture and the shoulder providing an edge which engages a portion of the side wall of the housing defining said aperture, thereby to fasten the end plate to the housing.

18. The lighting fixture of claim 1 wherein each end plate comprises a planar body portion, the planar body portion having a pattern of heat removal slots formed therein for ventilation of the interior of the fixture.

19. The lighting fixture of claim 17 and further comprising at least one side bar mounted across opposing side walls of the housing on at least one end of said housing, each side bar having a slot formed in at least one end of each side bar, the means formed integrally with each end plate comprising at least one tab formed in a lower edge portion of the planar apron portion of the end plate, the at least one of the tabs snap-fitting into the at least one of the slots formed in the side bar on assembly of the side bar to the housing.

20. A lighting fixture having at least one lamp carried within the lighting fixture, comprising:

a housing having a top wall and at least one aperture formed in the top wall of the housing; and, at least one end plate mounted to each end of the housing, each end plate comprising a planar body portion and a planar apron portion formed integrally together along an integral connecting flange element, the planar apron portion being angled relative to the planar body portion, the planar body portion having a top wall flange and side wall flanges formed integrally along a top edge and side edges respectively thereof, the top wall flange carrying at least one tab element which is receivable into the at least one aperture formed in the top wall of the housing, the aperture formed in the top wall of the housing having a T-shape with a leg portion thereof extending toward the end of the housing and a slot portion terminating the T-shape, the tab element having a reduced-in-length neck portion extending downwardly from the top wall flange and a rectangular plate element terminating the tab element and being co-planar with that plane within which the top wall flange lies, the tab element being essentially resilient in a vertical direction, the plate element being received into the slot portion of the aperture from outwardly of the housing and the neck portion of the tab element fitting into the leg portion of said aperture, each end plate being thereby mounted to the housing through the use of means formed integrally with each of the end plates.

21. The lighting fixture of claim 20 wherein each side wall flange of each end plate carries one of the tab elements which is receivable into one of the apertures formed in each end of each of the side walls of the housing, the tab elements having an arcuate edge and a shoulder terminating the arcuate edge, the arcuate edge facilitating snap-fastening of the tab element into said aperture and the shoulder providing an edge which engages a portion of the side wall of the housing defining said aperture, thereby to fasten the end plate to the housing.

22. The lighting fixture of claim 21 and further comprising at least one side bar mounted across opposing side walls of the housing on at least one end of said housing, each side bar having a slot formed in at least one end of each side bar, means formed integrally with each end plate comprising at least one tab formed in a lower edge portion of the planar apron portion of the end plate, the at least one of the tabs snap-fitting into the at least one of the slots formed in the side bar on assembly of the side bar to the housing.

23. A lighting fixture having at least one lamp carried within the lighting fixture, comprising:

a housing having side walls depending therefrom and at least one aperture formed in each end of each of the side walls of the housing; and, at least one end plate mounted to each end of the housing, each end plate comprising a planar body portion and a planar apron portion formed integrally together along an integral connecting flange element, the planar apron portion being angled relative to the planar body portion, the planar body portion having a top wall flange and side wall flanges formed integrally along a top edge and side edges respectively thereof, each side wall flange of each end plate carrying one of the tab elements which is receivable into one of the apertures formed in each end of each of the side walls of the housing, the tab elements having an arcuate edge and a shoulder terminating the arcuate edge, the arcuate edge facilitating snap-fastening of the tab element into said aperture and the shoulder providing an edge which engages a portion of the side wall of the housing defining said aperture, thereby to fasten the end plate to the housing.

24. A lighting fixture having at least one lamp carried within the lighting fixture, comprising:

a housing having a top wall and at least one aperture formed in the top wall of the housing; and, at least one end plate mounted to each end of the housing, each end plate comprising a planar body portion and a planar apron portion formed integrally together along an integral connecting flange element, the planar apron portion being angled relative to the planar body portion, the planar body portion having a top wall flange and side wall flanges formed integrally along a top edge and side edges respectively thereof, the top wall flange carrying at least one tab element which is receivable into the at least one aperture formed in the top wall of the housing thus comprising means formed integrally with each of the end plates for mounting each end plate to the housing.

25. A lighting fixture having at least one lamp carried within the lighting fixture, comprising:

a housing having side walls and at least one aperture formed in each end of each of the side walls of the housing; and, at least one end plate mounted to each end of the housing, each end plate comprising a planar body portion and a planar apron portion formed integrally together along an integral connecting flange element, the planar apron portion being angled relative to the planar body portion, the planar body portion having a top wall flange and side wall flanges formed integrally along a top edge and side edges respectively thereof, each side wall flange of each end plate carrying at least one tab element which is receivable into one of the apertures formed in each end of each of the side walls of the housing for mounting to said housing and thus comprising means formed integrally with each of the end plates for mounting each end plate to the housing.

26. A lighting fixture having at least one lamp carried within the lighting fixture, comprising:

a housing having a top wall and at least one aperture formed in the top wall of the housing, the housing further having side walls depending from the top wall with at least one aperture being formed in each end of each of the side walls of the housing; and, at least one end plate mounted to each end of the housing, each end plate comprising a planar body portion and a planar apron portion formed integrally together along an integral connecting flange element, the planar apron portion being angled relative to the planar body portion, the planar body portion having a top wall flange and side wall flanges formed integrally along a top edge and side edges respectively thereof, the top wall flange carrying at least one first tab element which is receivable into the at least one aperture formed in the top wall of the housing, each side wall flange of each end plate carrying at least one second tab element which is receivable into one of the apertures formed in each end of each of the side walls of the housing, the end plates thus each being mounted to the housing through means formed integrally with each of the end plates for mounting each end plate to the housing.

27. The lighting fixture of claim 26 wherein the aperture formed in the top wall of the housing has a T-shape with a leg portion thereof extending toward the end of the housing a slot portion terminating the T-shape, the first tab element having a reduced-in-length neck portion extending downwardly from the top wall flange and a rectangular plate element terminating the first tab element and being co-planar with that plane within which the top wall flange lies, the first tab element being essentially resilient in a vertical direction, the plate element being received into the slot portion of the aperture from outwardly of the housing and the neck portion of the first tab element fitting into the leg portion of said aperture.

28. The lighting fixture of claim 26 wherein the second tab elements have an arcuate edge and a shoulder terminating the arcuate edge, the arcuate edge facilitating snap-fastening of the second tab element into said aperture and the shoulder providing an edge which engages a portion of the side wall of the housing defining said aperture, thereby to fasten the end plate to the housing.

29. The lighting fixture of claim 26 wherein the second tab elements each have an arcuate edge and a shoulder terminating the arcuate edge, the arcuate edge facilitating snap-fastening of each of the second tab elements respectively into one each of said apertures and the shoulder providing an edge which engages a portion of the side wall of the housing defining said aperture, thereby to fasten the end plate to the housing.

* * * * *